US009643238B2

(12) United States Patent
Ochiai et al.

(10) Patent No.: US 9,643,238 B2
(45) Date of Patent: May 9, 2017

(54) MANUFACTURING METHOD OF METAL SHELL FORMED BODY FOR SPARK PLUG, MANUFACTURING METHOD OF METAL SHELL FOR SPARK PLUG, AND SPARK PLUG MANUFACTURING METHOD

(71) Applicant: NGK SPARK PLUG CO., LTD., Nagoya-shi, Aichi (JP)

(72) Inventors: Satoru Ochiai, Nagakute (JP); Mitsunari Kariya, Kasugai (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/908,168

(22) PCT Filed: Jul. 7, 2014

(86) PCT No.: PCT/JP2014/003585

§ 371 (c)(1),
(2) Date: Jan. 28, 2016

(87) PCT Pub. No.: WO2015/056373

PCT Pub. Date: Apr. 23, 2015

(65) Prior Publication Data

US 2016/0207095 A1 Jul. 21, 2016

(30) Foreign Application Priority Data

Oct. 14, 2013 (JP) ..... 2013-214290

(51) Int. Cl.
*B21K 21/08* (2006.01)
*B21J 5/06* (2006.01)
*H01T 21/02* (2006.01)

(52) U.S. Cl.
CPC ..... *B21K 21/08* (2013.01); *B21J 5/06* (2013.01); *H01T 21/02* (2013.01)

(58) Field of Classification Search
CPC ..... B21K 21/08; H01T 21/02
See application file for complete search history.

(56) References Cited

U.S. PATENT DOCUMENTS 6,357,274 B1 * 3/2002 Tanaka ..... B21C 23/20 72/355.6
2003/0005740 A1 * 1/2003 Tanaka ..... B21K 21/08 72/355.6

(Continued)

FOREIGN PATENT DOCUMENTS

JP 2009-095854 A 5/2009 ..... B21J 5/06
JP 2012-143801 A 8/2012 ..... B21K 21/08
WO WO 94/10731 A1 5/1994 ..... B21K 21/08

OTHER PUBLICATIONS

International Search Report issued in corresponding International Patent Application No. PCT/JP2014/003585, dated Oct. 7, 2014.

*Primary Examiner* — Debra Sullivan
(74) *Attorney, Agent, or Firm* — Kusner & Jaffe

(57) ABSTRACT

There is provided a method of manufacturing a metal shell formed body by cold forging for a metal shell of a spark plug. In the manufacturing method, a semi-finished formed body is first provided with a second inner step without the formation of an annular front end portion. After the semi-finished formed body is inserted from its front end side into a die, a punch is pushed into the semi-finished formed body from its rear end side. By pushing the punch, an annular front-facing surface of the punch is pushed onto the second inner step so as to press a front end portion of the formed body against an annular front end portion forming part of the die. By such a forming step, the metal shell formed body is obtained in which the annular front end portion is formed by extrusion.

9 Claims, 16 Drawing Sheets

(56) References Cited

U.S. PATENT DOCUMENTS

2004/0145290 A1* 7/2004 Ando ..... H01T 21/02
313/143
2010/0223973 A1* 9/2010 Kariya ..... B21K 1/28
72/254

* cited by examiner

*PRIOR ART*

*PRIOR ART*

*PRIOR ART*

*PRIOR ART*

*PRIOR ART*

PRIOR ART

MANUFACTURING METHOD OF METAL SHELL FORMED BODY FOR SPARK PLUG, MANUFACTURING METHOD OF METAL SHELL FOR SPARK PLUG, AND SPARK PLUG MANUFACTURING METHOD

FIELD OF THE INVENTION

The present invention relates to a method of manufacturing a metal shell formed body that is a semi-finished product of a metal shell as one of main structural components of a spark plug used for ignition in an engine. The present invention also relates to a method of manufacturing a spark plug metal shell and a manufacturing method of a spark plug using such a metal shell.

BACKGROUND OF THE INVENTION

There is known a spark plug, of the type shown in FIG. 11, for ignition in an internal combustion engine such as vehicle engine. This spark plug 1 includes a metal shell 30 formed in a different-diameter cylindrical shape with a small-diameter front part and a large-diameter rear part, a hollow shaft-shaped (cylindrical) ceramic insulator 21 (also referred to as "cylindrical insulator" or "insulator") surrounded by and fixed in the metal shell 30 (hollow axial hole), a center electrode 5 protruding from a front end of the insulator 21 (i.e. lower side of FIG. 11) and a ground electrode 51 joined to a front end 31 of the metal shell 30 so as to define a spark discharge gap between a front end of the center electrode 5 and a distal end of the ground electrode 51. A threaded cylindrical portion 33 having an outer circumferential surface formed with a screw thread 34 (also just referred to as "thread") is provided as a small-diameter cylindrical portion on the front part of the metal shell 30. A polygonal screwing portion 37 is provided on the rear part of the metal shell 30. A flanged portion 36 (also just referred to as "flange") is provided on the metal shell 30 at a position between the polygonal screwing portion 37 and the thread 34. The spark plug 1 is accordingly mounted to the engine by turning the polygonal screwing portion 37, screwing the thread 34 into a plug hole (threaded hole) of the engine, and seating the flange 36 on a peripheral edge of the plug hole. It is herein noted that, when the terms "front" and "rear" are used to indicate the spark plug 1 or its structural components, such as metal shell 30, and parts (or portions) thereof in the present invention, the term "front" refers to a lower side of FIG. 11; and the term "rear" refers to a side opposite the front side (i.e. upper side of FIG. 11).

FIG. 12 is a schematic view of the metal shell 30 (also referred to as "spark plug metal shell") before being assembled into the spark plug 1 of FIG. 11. A front end portion of the metal shell 30 located adjacent to the front end 31 and in front of the threaded cylindrical portion 33 is annular-shaped (circular annular in shape) and adapted as an annular front end portion 32 extending over a predetermined length (e.g. about 1 to 3 mm) and having a non-threaded outer circumferential cylindrical surface that is made larger in diameter than a core diameter of the thread 34 (see the enlarged area of FIG. 12). An annular inward protrusion 43 is formed circumferentially on an inner circumferential surface 41 of the threaded cylindrical portion 33. A second inner step 44 is provided on a rear end side of the annular inward protrusion 43 such that an inner surface of the second inner step 44 is tapered down and reduced in diameter toward the front. A front-facing surface is formed on a front end part of the insulator 21 and supported on the second inner step 44 via a packing 60 (see the enlarged area of FIG. 11). A body part 39 of the metal shell 30 located in rear of the threaded cylindrical portion 34 has an inner circumferential surface 48 made larger in diameter than the inner surface 41 of the threaded cylindrical portion 34, with a first inner step 46 provided therebetween. A thin annular cylindrical portion 38 (annular crimp portion) is provided at a rear end of the body part 39 and processed into a crimped portion during the assembling. The flanged portion 36, the screwing polygonal portion 37 and the annular cylindrical portion 38 are arranged in this order from the front, thereby constituting the body part 39. The ground electrode (member) 51 before bending is welded to the front end 31 of the metal shell 30.

The above metal shell 30 is conventionally manufactured by producing a metal shell formed body (metal shell formed product) 30*f*, which has a different-diameter cylindrical shape and structure similar to the metal shell 30 with an axial hole formed therein for insertion of the insulator 21 as shown in FIG. 13, through cold forging process and then subjecting the metal shell formed body 30*f* to e.g. cutting and threading to form the thread 34 etc. (see, for example, Japanese Laid-Open Patent Publication No. 2009-095854). As the metal shell formed body 30*f* is similar in shape and structure to the metal shell 30, parts and portions of the metal shell formed body 30*f* corresponding to those of the metal shell 30 are principally designated by the same reference numerals in FIG. 13 as those in FIG. 12 in the present invention. However, parts and portions of the metal shell formed body 30*f* distinguished from the corresponding parts and portions of the metal shell 30 are designated by different names. For example, a cylindrical portion 35 of the metal shell formed body 30*f* to be processed into the threaded cylindrical portion 34 is referred to as "cylindrical intermediate portion 35"; and a front end portion 32 of the metal shell formed body 30*f* that is located in front of the cylindrical intermediate portion 35 and that is made smaller in outer diameter than the cylindrical intermediate portion 35 is referred to as "annular front end portion 32". The axial hole is made through the center axis of the metal shell formed body 30*f* according to the inner circumferential shape of the metal shell 30. As shown in FIG. 13, an inner circumferential surface of the axial hole includes, in the order from the rear (i.e. upper side) to the front, a large-diameter hole region 48*a*, a first middle-diameter hole region 41*a* smaller in diameter than the large-diameter hole region 48*a*, a small-diameter hole region 43*a* smaller in diameter than the first middle-diameter hole region 41*a* and a second middle-diameter hole region 41*b* larger in diameter than the small-diameter hole region 43*a*. The configuration of this metal shell formed body will be explained in detail later.

FIG. 14 is a schematic view showing changes in the shape of the formed body during the cold forging process until the completion of the metal shell formed body 30*f*. In FIG. 14, the metal shell formed body 30*f* is obtained from a short rod-shaped starting raw material S (see the upper left illustration of FIG. 14) through a series of forming steps. After the completion of the metal shell formed body 30*f* by the final step of the forging process, the metal shell formed body 30*f* is subjected to cutting as required and thereby obtained as a metal shell cut body. Then, the ground electrode (member) is joined by welding to the front end of the metal shell formed body. The metal shell 30 (finished product) is completed by performing various processing operations to e.g. form thread on an outer circumferential surface of the cylindrical intermediate portion 35 of the metal shell formed body. Depending on the kind of the metal shell, the thread may be formed on the metal shell formed body before the cutting. The spark plug of FIG. 11 is manufactured by inserting the insulator 21 into the axial hole of the metal shell 30 from the rear end side, with the center electrode 5 protruding from the front end of the insulator 21, to bring the annular front-facing surface of the large-diameter part of the insulator into contact with the second inner step 44 of the annular inward protrusion 43 on the inner circumferential surface 41 of the metal shell 30 via the packing 60, and crimping the rear end portion (annular crimp portion) 38 of the metal shell 30 inwardly and frontwardly. The spark discharge gap is set by bending the ground electrode 51.

As mentioned above, the final formed product (metal shell formed body 30*f*) obtained by the plurality of cold forging steps has a different-diameter cylindrical appearance close to that of the metal shell 30 as shown in FIG. 13. In FIG. 13, the corresponding parts and portions are principally designated by the same reference numerals as those in FIG. 12 as mentioned above. As in the case of the metal shell 30, a rear cylindrical part of the metal shell formed body 30*f* is provided as a body part 39 with a radially outwardly protruding flanged portion 36. The cylindrical intermediate portion 35, on which the thread 34 is to be formed by the above-mentioned threading step, is provided on the metal shell formed body 30*f* in front of the body part 39. The annular front end portion 32, which is smaller in outer diameter than the cylindrical intermediate portion 35, is provided on the metal shell formed body 30*f* in front of the cylindrical intermediate portion 35 over a predetermined range from the front end 31 toward the rear (see the enlarged area of FIG. 13) as corresponding to that of the metal shell. In the metal shell formed body 30*f*, the large-diameter hole region 48*a* and the first middle-diameter hole region 41*a* are defined by an inner circumferential surface 48 of the body part 39 and an inner circumferential surface 41 of the cylindrical intermediate portion 35, respectively, according to the inner circumferential shape of the metal shell. A first inner step 46 is provided between the large-diameter hole region 48*a* and the first middle-diameter hole region 41*a*. Further, the small-diameter hole region 43*a* is defined by an inner circumferential surface of the annular inward protrusion 43. A second inner step 44 is provided between the first middle-diameter hole region 41*a* and the small-diameter hole region 43*a* such that an inner surface of the second inner step 44 is tapered down and reduced in diameter toward the front as a supporting surface to support thereon the insulator 21.

The annular front end portion 32 is conventionally formed on the metal shell formed body in front of the cylindrical intermediate portion 35 in the second step of FIG. 15-2 after the first step (forging step) of FIG. 15-1. It is herein noted that the formed bodies of FIG. 14 (illustrations 1-5) correspond to those formed in the respective process steps of FIG. 15 (illustrations 1-5). In the first step, the starting raw material S is subjected to drawing (cylindrical shaping) and hollow shaping as shown in FIG. 15-1. By the drawing, the outer diameter of the front part of the formed body is made close to the outer diameter of the cylindrical intermediate portion 35 to be processed into the threaded cylindrical portion 33 of the metal shell. The inner diameter of the front part of the formed body is adjusted by the hollow shaping. In the second step, the rear part of the formed body is subjected to diameter expansion and hollow shaping as shown in FIG. 15-2. Simultaneously with the diameter expansion and hollow shaping, the cylindrical drawn front part of the formed part is shaped such that the outer circumference of the front end portion of the cylindrical drawn part (see the area P1 in FIG. 14-2 and in FIG. 15-2) corresponds in shape to the annular front end portion 32 that is smaller in outer diameter than the cylindrical intermediate portion 35. This forming operation is performed by the use of a die (i.e. die 200 as shown in FIG. 15-2) having a working surface shaped corresponding to the annular front end portion 32 that is smaller in outer diameter than the cylindrical intermediate portion 35, i.e., by pressing the front end portion of the cylindrical drawn part of the formed body against the working surface of the die. In the third step (see FIG. 15-3), a punch is pushed into the formed body from its rear end side so as to extrude the rear part of the formed body toward the rear and, at the same time, extend the front part of the formed body and thereby form the cylindrical intermediate portion 35. In the fourth step (see FIG. 15-4), a polygonal portion 37 is formed on the formed body. During the fourth step, an inner bottom wall of the formed body is made thinner (see FIG. 15-4). This thin bottom wall is punched out so as to define the small-diameter hole region (annular inward protrusion) 43*a* by the inner circumferential surface of the cylindrical intermediate portion 35 in the fifth step (see the illustration 5 of FIG. 15). The metal shell formed body 30*f* is then completed as shown in FIG. 14-5. In the above process, it is necessary in the third step to use a die (203) having an inner circumferential surface (see the area P3 in FIG. 15-3) shaped corresponding to the annular front end portion 32 in front of the outer circumferential surface of the cylindrical intermediate portion such that the annular front end portion 32 can sustain a forging pressure.

By the way, there is no difference in thread appearance and dimensions among metal shells for spark plugs when the metal shells are of same thread diameter and length. However, the inner circumferential profile of the metal shell, i.e., the inner circumferential profile of the metal shell formed body as a semi-finished product of the metal shell, except the large-diameter hole region 48*a*, varies from product to product as shown in the left and right section views of FIG. 16. More specifically, the axial lengths and positions of the first middle-diameter hole region 41*a*, the small-diameter hole region 43*a* and the second middle-diameter hole region 41*b* change from product to product. It is because the axial lengths and positions of the respective holes 41*a*, 43 and 41*b* change as the axial position of the second inner step 44 varies depending on the performance such as heat resistance required for the spark plug. In a metal shell for use in a high combustion temperature engine such as supercharger-equipped engine, for example, the second inner step 44 is located closer to the front end as shown in the right section view of FIG. 16 as compared to that in an engine with no supercharger even when the thread diameter and length are the same. Even when the thread diameter and length are the same, the axial position of the second inner step 44 is slightly changed according to the thermal value of spark plug and according to the kind of the engines and vehicle. Namely, there are a plurality of kinds of metal shells of the same thread diameter and length. Further, the metal shells of the same thread diameter can have different thread lengths. The axial position of the second inner step 44 can be set to various positions among the metal shells. In consequence, there are a plurality of kinds of metal shells depending on the thread length and the axial position of the second inner step 44 even when the metal shells are of the same thread diameter.

In the above forging process in which the annular front end portion 32 is formed in the second step, it is necessary to slightly vary the lengths of the cylindrical front parts of the second-step formed products for manufacturing of the metal shell formed bodies 30*f* with different axial positions of second inner steps 44 for metal shells of the same thread diameter and length. The reason for this is that, in the case where the axial positions of the second inner steps 44 differ as shown in the left and right section views of FIG. 16 even though the cylindrical intermediate portions 35 are of the same length in the final metal shell formed bodies 30*f*, the flow conditions of the workpiece materials need to be set differently in the second step according to such differences in the axial positions of the second inner steps 44. To manufacture the formed bodies of the same thread diameter and length but different second inner step positions, the die (lower die 200 of FIG. 15-2 used in the second step for formation of the annular front end portion 32 has to be changed among those having different working parts (working surfaces) according to the lengths of the cylindrical front end portions of the formed bodies. There is thus a need to use a number of dies (in the second step) corresponding to the axial length of the second inner step 44. In addition, there is also a need in the third step to change the die 203 shape to correspond to the annular front end portion 32 since the annular front end portion 32 formed in the second step has to sustain the forging pressure applied in the third step (see the area P3 of FIG. 15-3).

As mentioned above, the metal shells can have a plurality of kinds of thread lengths depending on the performance required for the spark plugs even though the thread diameters of the metal shells are the same. The axial positions of the second inner steps 44 can vary among the metal shells with such different thread lengths. There is thus a need in the conventional cold forging process, in which the annular front end portion 32 is formed in the above-mentioned forming step (second step), to properly use a number of dies corresponding to the length of the thread 34 and the axial position of the second inner step 44 even in the case of manufacturing the metal shell formed bodies with the same thread diameter. There is also a need to use a number of dies corresponding to the shape of the annular front end portion 32 in the third step. This leads to increases in die production and management costs.

In the case of manufacturing the metal shell formed bodies of different kinds where only the axial position of the second inner step 44 varies from kind to kind, it is necessary to replace the die for formation of the annular front end portion 32 even though the thread diameter and length are the same. Such replacement requires complicated operation with delicate adjustment for proper positioning of the die. This leads to a deterioration in the manufacturing efficiency of the metal shell formed body (metal shell) and becomes a cause of increase in the cost of the spark plug.

The present invention has been made to solve the above problems in the conventional manufacturing method of the metal shell formed body. An advantage of the present invention is a method of manufacturing metal shell formed bodies for metal shells by cold forging in which, as long as the annular front end portions of the metal shell formed bodies are the same in outer diameter and axial length, it is possible to reduce the number or kinds of dies required for formation of the annular front end portions and improve the manufacturing efficiency of the metal shell formed bodies when the metal shells are the same in thread diameter but different in second inner step position or slightly different in thread length.

SUMMARY OF THE INVENTION

In accordance with a first aspect of the present invention, there is provided a method of manufacturing a metal shell formed body for a spark plug, the metal shell formed body comprising: a body part having formed therein an axial hole for insertion of an insulator and having formed thereon a radially outwardly protruding flanged portion; a cylindrical intermediate portion located in front of the body part; and an annular front end portion located in front of the cylindrical intermediate portion and made smaller in outer diameter than the cylindrical intermediate portion, the method comprising the steps of:

(a) a semi-finished formed body producing step for producing a semi-finished formed body from a metal material, the semi-finished formed body having an axial hole formed therein along a center axis thereof such that the axial hole includes, in order of mention from the rear to the front, a large-diameter hole region, a first middle-diameter hole region smaller in diameter than the large-diameter hole region, a small-diameter hole region smaller in diameter than the first middle-diameter hole region and a second middle-diameter hole region larger in diameter than the small-diameter hole region; and (b) an annular front end portion forming step for, after the semi-finished formed body producing step, forming the annular front end portion.

In accordance with a second aspect of the present invention, there is provided a method of manufacturing a metal shell formed body for a spark plug as described above, wherein the semi-finished formed body producing step includes forming a first inner step between the large-diameter hole region and the first middle-diameter hole region and forming a second inner step between the first middle-diameter hole region and the small-diameter hole region; and wherein the annular front end portion forming step includes:

providing a die, the die being fittable around the semi-finished formed body by clearance fitting and having an inner circumferential cylindrical surface shaped to mate with the cylindrical intermediate portion, a reduced-diameter inner cylindrical surface smaller in inner diameter than the inner circumferential cylindrical surface and a tapered inner circumferential surface between the inner circumferential cylindrical surface and the reduced-diameter inner cylindrical surface;

providing a punch, the punch having an annular front-facing surface shaped to push at least one of the first and second inner steps; and inserting and placing the semi-finished formed body from a front end side thereof into the die; and pushing the punch into the semi-finished formed body from a rear end side thereof so as to, by pushing of the annular front-facing surface onto at least one of the first and second inner steps, force the semi-finished formed body toward the front, press a front end portion of the semi-finished formed body against the reduced-diameter inner cylindrical surface and the tapered inner circumferential surface of the die and thereby form the annular front end portion by cold forging.

In accordance with a third aspect of the present invention, there is provided a method of manufacturing a metal shell formed body for a spark plug according to the second aspect of the present invention, wherein the punch is shaped to push both of the first and second inner steps and force the semi-finished formed body toward the front.

In accordance with a fourth aspect of the present invention, there is provided a method of a metal shell formed body for a spark plug according to the first aspect of the present invention, wherein the manufacturing method further comprises, after the semi-finished formed body producing step, a step for forming a second inner step between the first middle-diameter hole region and the small-diameter hole region in addition to the annular front end portion forming step for forming the annular front end portion.

In accordance with a fifth aspect of the present invention, there is provided a method of manufacturing a metal shell formed body for a spark plug according to the fourth aspect of the present invention, wherein the semi-finished formed body producing step includes forming a first inner step between the large-diameter hole region and the first middle-diameter hole region and forming a temporary tapered portion between the first middle-diameter hole region and the small-diameter hole region; and wherein the annular front end portion forming step includes:

providing a die, the die being fittable around the semi-finished formed body by clearance fitting and having an inner circumferential cylindrical surface shaped to mate with the cylindrical intermediate portion, a reduced-diameter inner cylindrical surface smaller in inner diameter than the inner circumferential cylindrical surface and a tapered inner circumferential surface between the inner circumferential cylindrical surface and the reduced-diameter inner cylindrical surface;

providing a punch, the punch having an annular front-facing surface shaped to push the first inner step and a small-diameter hole region forming surface shaped to push the temporary tapered portion; and inserting and placing the semi-finished formed body from a front end side thereof into the die; and pushing the punch into the semi-finished formed body from a rear end side thereof so as to, by at least one of pushing of the annular front-facing surface onto the first inner step and pushing of the small-diameter hole region forming surface onto the temporary tapered portion, force the semi-finished formed body toward the front, press a front end portion of the semi-finished formed body against the reduced-diameter inner cylindrical surface and the tapered inner circumferential surface of the die and thereby form the annular front end portion by cold forging and, at the same time, press the small-diameter hole region forming surface of the punch against the temporary tapered portion of the semi-finished formed body and thereby form the second inner step by cold forging.

In accordance with a sixth aspect of the present invention, there is provided a method of manufacturing a metal shell formed body for a spark plug according to any one of the third to fifth aspects of the present invention, wherein an axial dimension of the small-diameter hole region of the semi-finished formed body is larger than a design dimension of a small-diameter hole region of the metal shell formed body; and wherein an axial dimension from the first inner step to the second inner step of the semi-finished formed body is smaller than a design dimension between first and second inner steps of the metal shell formed body.

In accordance with a seventh aspect of the present invention, there is provided a method of manufacturing a metal shell for a spark plug, comprising:

manufacturing the metal shell formed body by the manufacturing method according to any one of the first to sixth aspects of the present invention; and forming a thread on at least a part of the cylindrical intermediate portion of the metal shell formed body.

In accordance with an eighth aspect of the present invention, there is provided a method of manufacturing a spark plug, comprising:

manufacturing the metal shell by the manufacturing method according to the seventh aspect of the present invention; and placing an insulator in the metal shell.

The above manufacturing method of the present invention enables manufacturing of the metal shell formed bodies with the use of one kind of die in the annular front end portion forming step, as long as the annular front end portions of the metal shell formed body are the same in shape and dimensions, even though the metal shell formed bodies have their respective cylindrical intermediate portions formed with the same outer diameter (for formation of threads with the same thread diameter) but differ in the axial position of the annular inward protrusion in the small-diameter hole region or the axial position of the second inner step or slightly differ in the length of the thread. It is therefore possible to significantly reduce the number of dies as compared to that in the conventional manufacturing method and, at the time of shifting to manufacturing of metal shell formed bodies of different kind where the axial position of the small-diameter hole region with the annular inward protrusion or the axial position of the second inner step differs although the metal shell formed bodies are of the same thread diameter, possible to allow not only easy die management but also simple and quick replacement/positioning of the die in a multistage forging machine.

There is no particular limitation on the part of the semi-finished formed body pushed in the annular front end portion forming step as long as the annular front end portion can be formed in the annular front end portion forming step. In general, a metal shell for a spark plug has a polygonal portion formed for screwing the spark plug into an engine plug hole and an annular crimp portion formed at a rear end thereof for crimping during manufacturing of the spark plug. Depending on the kind of the metal shell formed body, it is conceivable to press a portion of the formed body corresponding to such a polygonal portion or crimp portion. For example, a rear-facing surface of the polygonal screwing portion may be pushed. A rear-facing surface of the annular crimp portion may be pushed. However, the rear-facing surface of the polygonal screwing portion is narrow in width; and the rear-facing surface of the annular crimp portion is thin and located far from the annular front end portion. The pushing of such a portion may become unstable in the case where large pushing force is required. On the other hand, this problem does not occur in the pushing of the inner step as set forth in the second or third aspect of the present invention. In other words, it is preferable to push the inner step as set forth in the second or third aspect of the present invention in view of work hardening of the outer circumferential surface of the front end region of the cylindrical intermediate portion and the radial widths (corresponding to thicknesses) of the rear-facing surfaces of the respective portions.

In the second aspect of the present invention, at least one of the first and second inner steps is pushed by the annular front-facing surface of the punch so as to force the semi-finished formed body toward the front. Although either one of the first and second inner step can be pushed, it is preferable to push both of the first and second inner steps as set forth in the third aspect of the present invention. By pushing both of the first and second inner steps as set forth in the third aspect of the present invention, it is possible to stably force the semi-finished formed body toward the front and improve the accuracy of the axial dimension between the first and second inner steps.

As mentioned above, the semi-finished formed body is forced toward the front by pushing the annular front-facing surface of the punch onto at least one of the first and second inner steps in the second aspect of the present invention. In this case, it is feasible to push the punch, which has either or both of a rear annular front-facing surface shaped to push the first inner step and a front annular front-facing surface shaped to push the second inner step, into the semi-finished formed body from its rear end side and force the semi-finished formed body toward the front by at least one of pushing of the rear annular front-facing surface onto the first inner step and pushing of the front annular front-facing surface onto the second inner step. This forming step can be broadly divided into the following two cases A and B.

The case A corresponds to where the annular front end portion is formed by pushing the punch, bringing at least one of the front and rear annular front-facing surfaces of the punch into contact with the first inner step or the second inner step and pressing the punch and the semi-finished formed body together against the die.

The case B corresponds to where the annular front end portion is formed by pushing the punch and pressing the punch and the semi-finished formed body together against the die in such a way that: the formation of the annular front end portion is initiated before the rear or front annular front-facing surface of the punch is brought into contact with the first or second inner step; and, during such formation, the rear or front annular front-facing surface of the punch is brought into contact with the first or second inner step.

As set forth in the fourth aspect of the present invention, the step for forming the second inner step between the first middle-diameter hole region and the small-diameter hole region as well as the annular front end portion forming step for forming the annular front end portion may be performed after the semi-finished formed body producing step. In this case, it is feasible to push the punch, which has an annular front-facing surface shaped to push the first inner step and a small-diameter hole region forming surface shaped to push the temporary tapered portion, into the semi-finished formed body from its rear end side and force the semi-finished formed body toward the front by at least one of pushing of the annular front-facing surface onto the first inner step and pushing of the small-diameter hole region forming surface onto the temporary tapered portion as set forth in the fifth aspect of the present invention. This forming step can be broadly divided into the following two cases A and B.

The case A corresponds to where, when the punch is pushed, the annular front-facing surface of the punch is brought into contact with the first inner step such that the punch and the semi-finished formed body are pressed together against the die. In such a case, there are the following situations: one is to form the annular front end portion by pressing the first inner step; and the other is to form the annular front end portion and, at the same time, form the second inner step by bring the small-diameter hole region forming surface of the punch into contact with the temporary tapered portion and thereby pressing the temporary tapered portion.

The case B corresponds to where the punch and the semi-finished formed body are pressed together against the die before the annular front-facing surface of the punch is brought into contact with the temporary tapered portion. In this case, there are the following situations: one is to form the annular front end portion by bringing the small-diameter hole region forming surface of the punch into contact with the temporary tapered portion and thereby pressing the temporary tapered portion; and the other is to partially form the annular front end portion the second inner step by bringing the small-diameter hole region forming surface of the punch into contact with the temporary tapered portion and thereby pressing the temporary tapered portion, and then, form the remainder of the annular front end portion by bringing the annular front-facing surface of the punch into contact with the first inner step and thereby pressing the first inner step, or to form the annular front end portion and, at the same time, form the second inner step by bringing the small-diameter hole region forming surface of the punch into contact with the temporary tapered portion The difference in the above forming operation patterns is due to variations between the mutual axial dimensions of the respective parts of the semi-finished formed body to be processed in the first and second inner steps etc. This difference is not however essential since the final state (cold forged state) of the metal shell formed body and the die-closing state of the die during the cold forging are the same.

In the third to fifth aspects of the present invention, the dimensions of the semi-finished formed body are preferably set as set forth in the sixth aspect of the present invention. By such dimensional control, it is possible to improve the accuracy of the finishing axial dimension between the first and second inner steps during the annular front end portion forming step.

DETAILED DESCRIPTION OF THE PREFERRED EMBODIMENTS

Figure 1:
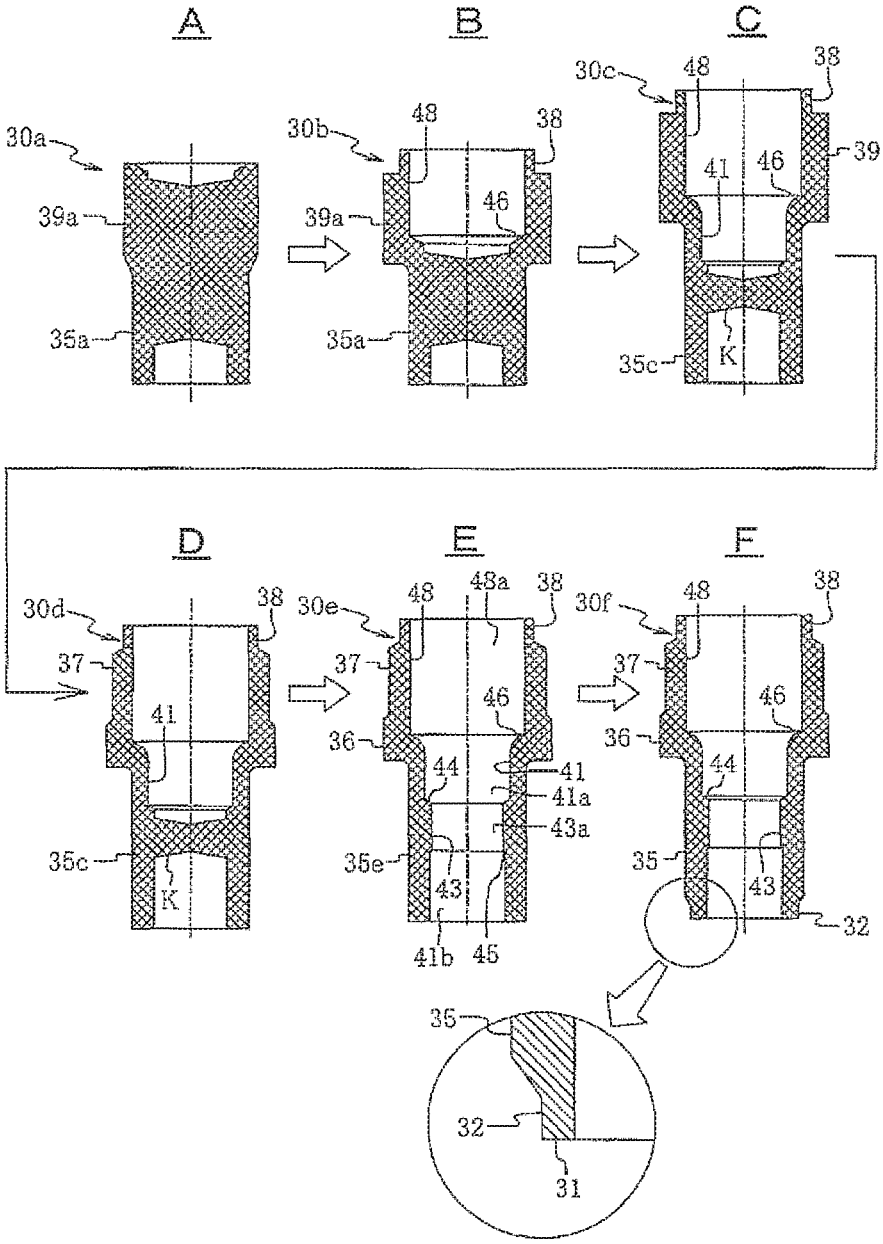
FIG. 1 shows cross sections of formed bodies (A-F) in respective steps of cold forging process for formation of a metal shell formed body from a starting raw material according to one embodiment of the present invention.
Figure 12:
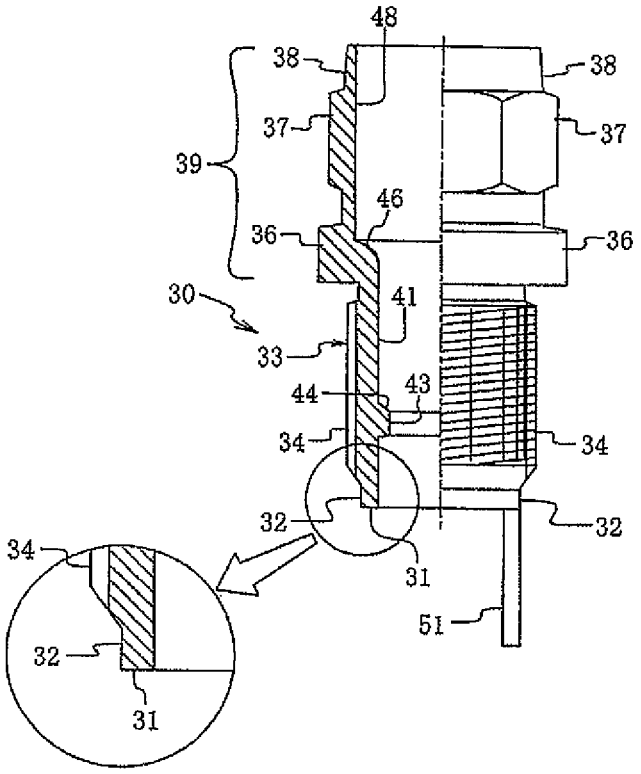
FIG. 12 shows a cross section of a metal shell before being assembled into the spark plug of FIG. 11.
Figure 13:
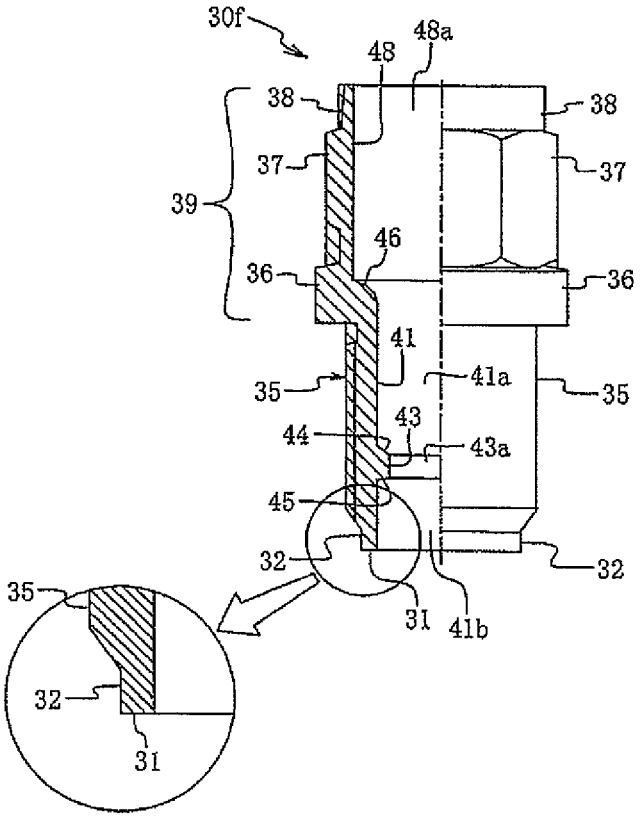
FIG. 13 shows, half in section, a metal shell formed body before being subjected to cutting for manufacturing of the metal shell of FIG. 12.
Figure 14:
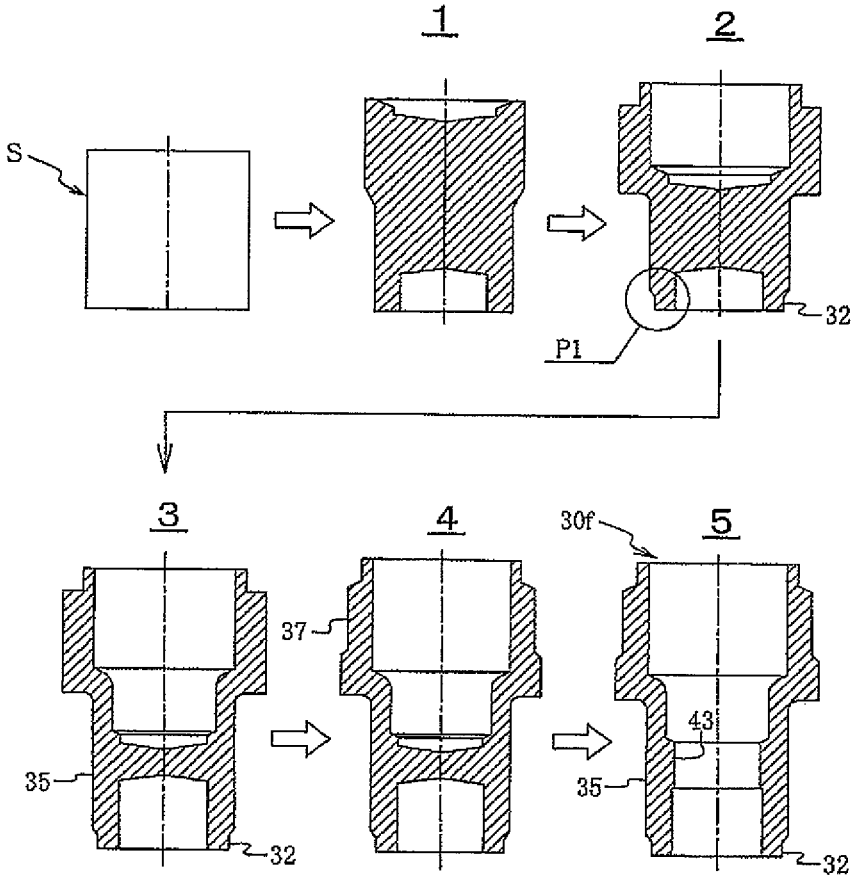
FIG. 14 shows of formed bodies (semi-finished products) in respective steps of cold forging process for formation of the metal shell formed body of FIG. 13 from a starting raw material.
Figure 15:
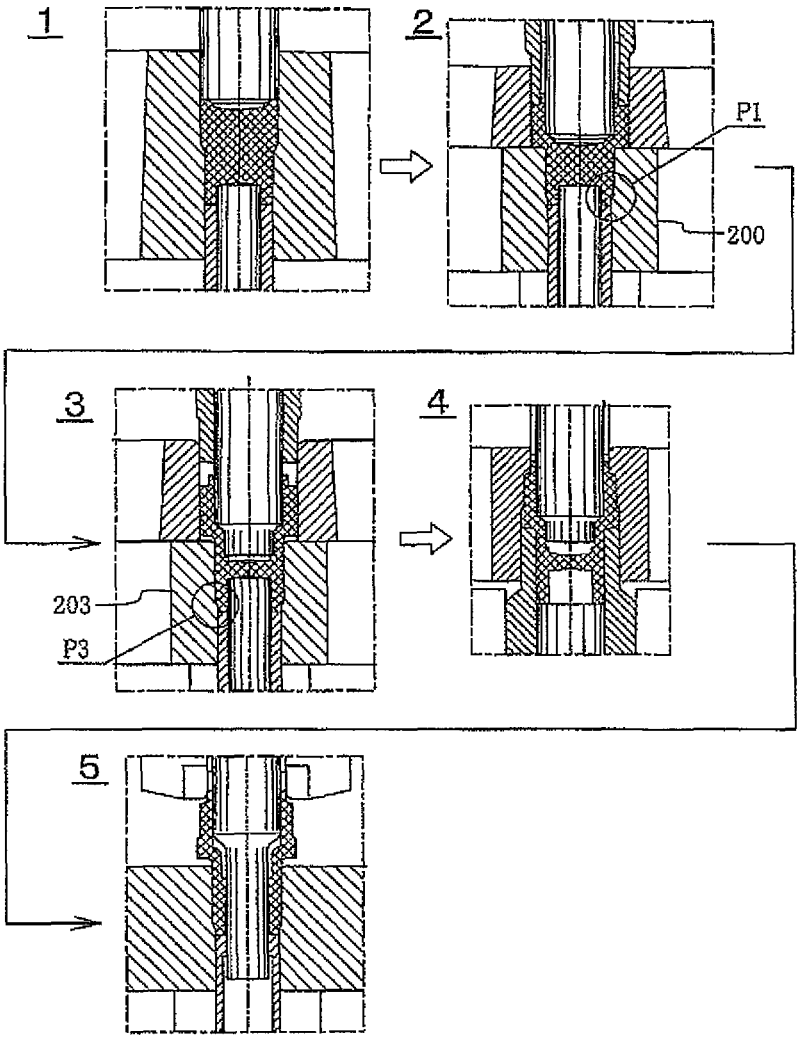
FIG. 15 shows cross sections of dies used in the first to fifth steps for formation of the metal shell formed body of FIG. 13.

A manufacturing method (cold forging method) of a metal shell formed body for a spark plug according to one embodiment (first embodiment) of the present invention will be described below with reference to FIGS. 1 to 7. As the metal shell formed body 30*f* manufactured in the present embodiment is substantially the same as that shown in FIG. 13, an explanation of the metal shell formed body itself will be omitted herefrom. FIG. 1 shows a series of six process steps A to F for forming (manufacturing) the metal shell formed body 30*f* in the present embodiment. The respective process steps (first to sixth steps) until the completion of the metal shell formed body 30 (sixth-step formed product) in the sixth step (final forging step; as corresponding to the claimed annular front end portion forming step) will be explained one by one with reference to FIG. 1. FIGS. 2 to 6 respectively show the first to fifth steps (as corresponding to the claimed semi-finished formed body producing step). In each of FIGS. 2 to 6, the left side of the center line (vertical center line) is a half section of the raw material (semi-finished formed body) before the corresponding step; and the right side of the center line (vertical center line) is a half section of the formed body (formed product) after the corresponding step. In the respective cross sections of FIGS. 2 to 7, cross hatching of any dies other than upper and lower main dies (such as die and punch) are omitted as appropriate. In FIGS. 1 to 7, the parts and portions of the formed body corresponding to those of the metal shell (or metal shell formed body) in FIGS. 12 and 13 are principally designated by the same reference numerals.

The details of the respective process steps are as follows. In the present embodiment, the raw material (cylindrical column-shaped material) is sequentially subjected to forming as shown in FIG. 1. Through the cold forging operations from the first to fifth steps (semi-finished formed body producing step) as shown in FIGS. 2 to 6, the raw material is formed into a semi-finished formed body 30*e* (fifth-step formed product) (see the illustration E of FIG. 1) before the final forming step for completion of the metal shell formed body. The semi-finished formed body 30*e* is in a state before the formation of the annular front end portion 32 in front of the cylindrical intermediate portion 35 to be threaded. Then, the semi-finished formed body 30*e* is inserted and placed into a die (lower die) as shown in the left side of FIG. 7, followed by pushing a punch 240*f* into the semi-finished formed body 30*e* from its upper end side as shown in the right side of FIG. 7. In such an annular front end portion forming step, the semi-finished formed body 30*f* (sixth-step formed product) is obtained in which the annular front end portion 32 is formed in front of the cylindrical intermediate portion 35 to be threaded (see the illustration F of FIG. 1). The die (lower die) 200*f* used in this sixth step is fitted around the semi-finished formed body by clearance fitting and has a circular hole formed with an inner circumferential cylindrical surface 203*f* so as to mate with a cylindrical part (circular cylindrical part) 35*e* of the semi-finished formed body 30*e*, which is to be processed into the cylindrical intermediate portion 35 and the annular front end portion 32 of the metal shell formed body 30*f*, with substantially no clearance left therebetween, and a circular hole located coaxially at a lower end of the above-mentioned circular hole and formed with a reduced-diameter inner cylindrical surface 206*f* so as to shape the outer circumferential surface of the annular front end portion 32. There is a tapered inner circumferential surface (rear-facing annular surface) 205*f* tapered down between the inner circumferential cylindrical surface 203*f* and the reduced-diameter inner cylindrical surface 206*f* in the die 200*f*. An inner diameter of the reduced-diameter inner cylindrical surface 206*f* is set equal to an outer diameter of the annular front end portion 32.

Namely, the semi-finished formed body 30*e* (fifth-step formed product 30*e*) having the cylindrical part 35*e*, which is to be processed into the cylindrical intermediate portion 35 and the annular front end portion 32 of the metal shell formed body 30*f*, is formed as shown in the illustration E of FIG. 1 before the formation of the metal shell formed body 30*f* as shown in the illustration F of FIG. 1. The semi-finished formed body 30*e* is inserted and placed from its front end side into the die (lower die) 200*f* (see the left side of FIG. 7). As mentioned above, the die 200*f* is fitted around the semi-finished formed body by clearance fitting and has the inner circumferential cylindrical surface 203*f* shaped to mate with the cylindrical part 35*e*, the tapered inner circumferential surface 205*f* and the reduced-diameter inner cylindrical surface 206*f* as an annular front end portion forming surface whose inner diameter is reduced to be equal to the outer diameter of the annular front end portion 32. Then, the punch (upper die) 240*f* is pushed into the semi-finished formed body 30*e* from its rear end side (upper side) (see the left side of FIG. 7). The punch 240*f* has an annular front-facing surface 243*f* shaped to push the second inner step 44 of the semi-finished formed body 30*e*. By pushing the punch, the annular front-facing surface 243*f* of the punch is pushed onto the second inner step 44 of the semi-finished formed body 30*e* so as to force the semi-finished formed body 30*e* toward the front (front end side) and press a front end portion (lower end portion in FIG. 7) of the cylindrical part 35*e* of the semi-finished formed body 30*e* against the tapered inner circumferential surface 205*f* and the reduced-diameter inner cylindrical surface 206*f* as the annular front end portion forming surface of the die. In this pushing, the annular front end portion 32 is formed by extrusion (see the enlarged area in the right side of FIG. 7) in front of the cylindrical intermediate portion 35. There is thus completed the metal shell formed body 30*f* as shown in the illustration F of FIG. 1. Hereinafter, the first to fifth steps as the semi-finished formed body producing step (cold forging step) and the sixth step as the annular front end portion forming step) will be respectively explained in detail below.

First Step

Figure 2:
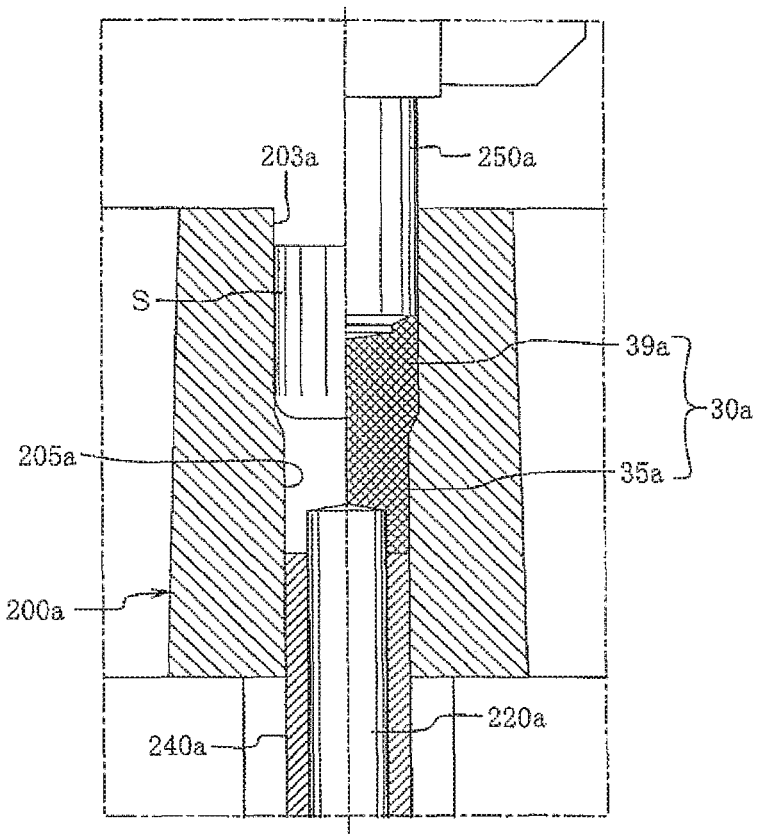
FIG. 2 schematically shows the first step for formation of the semi-finished formed body (A) of FIG. 1 by the use of a die, where the left side is a section view of the formed body before extrusion; and the right side is a section view of the formed body after extrusion.

As shown in FIG. 2, the first step is performed by the use of a lower die (die) 200*a* having a different-diameter circular hole (hollow hole) with a large-diameter upper hole region 203*a* and a small-diameter lower hole region. The cylindrical column-shaped starting raw material S, which has been cut out according to the size of the finished product, is inserted and placed into the circular hole region 203*a* of the die from above (see the left side of the vertical center line (center line) in FIG. 2). Herein, an inner diameter of the small-diameter lower circular hole region 205*a* is set slightly smaller than the outer diameter of the cylindrical intermediate portion 35 of the metal shell formed body 30*f* of FIG. 13; and an inner diameter of the large-diameter upper circular hole region 203*a* is set substantially equal to the outer diameter of the annular cylindrical crimp portion 38 of the metal shell formed body 30*f* of FIG. 13. After the insertion and placement of the raw material, a cylindrical column-shaped supporting punch (pin) 220*a* and a sleeve 240*a* are inserted into the small-diameter circular hole region 205*a* of the die from below. A circular shaft-shaped punch 250*a* is pushed into the raw material S from above such that the raw material S is compressed between an end face of the punch 250*a* and end faces of the punch 220*a* and the sleeve 240*a*. Thus, a first-step formed product (different-diameter cylindrical column-shaped formed body) 30*a* is obtained (see FIG. 1-A and FIG. 2). The first-step formed product 30*a* has a large-diameter rear part 39*a* and a small-diameter part 35*a*, with a tapered portion provided therebetween, as shown in the right side of the center line in FIG. 2. Further, recesses are formed in the centers of both front and rear end faces of the first-step formed product 30*a*. After the completion of the above forming operation, the first-step formed product 30*a* is discharged out by pulling out the punch 250*a* and knocking out the supporting punch 220*a* in synchronism with the punch 250*a*. In the respective process steps, the coaxial vertical movement of the die, the driving (vertical movement) of the supporting punch and the knock-out pin (knock-out sleeve) for support of the raw material (semi-finished formed body) and the discharging of the formed body are known techniques. An explanation of these techniques will be omitted hereinafter.

Second Step

As explained below with reference to FIG. 3, the second step is performed by the use of a die 200*b* assembled from first and second lower die components 201*b* and 202*b*. The first lower die component 201*b* has a circular hole 203*b* shaped to restrain an outer circumferential surface of the small-diameter part 35*a* of the first-step formed product 30*a*, whereas the second lower die component 202*b* is located above the first lower die component 201*b* and has a circular hole coaxial with the circular hole 203*b*. The circular hole 207*b* of the second lower die component 202*b* has an inner circumferential surface substantially equal in diameter to the outer circular circumferential surface of the flange 36 of the metal shell formed body 30*f* of FIG. 13. A cylindrical column-shaped supporting pin 220*b* and a cylindrical sleeve 270*b* are inserted into the circular hole 203*b* of the die 200*b* from below.

A hole punch 240*b* is arranged at an upper side of the die (lower die) 200*b* coaxially (concentrically) with the circular holes 203*b* and 207*b*. This hole punch 240*b* is designed to form a bottomed circular hole in the rear end face of the large-diameter part 39*a* of the first-step formed product 30*a* and thereby shape the inner circumferential surface of the large-diameter body part 39 such as thin annular crimp portion 38 and flange 36 of the metal shell formed body 30*f*. Consequently, the hole punch 240*b* is circular in section; and an outer diameter of the hole punch 240*b* is set substantially equal to the inner diameter of the inner circumferential surface 48 of the body part 39 of the metal shell formed body 30*f*, i.e., the inner diameter of the large-diameter hole region 48*a*. However, a front end part of the hole punch 240*b* is made relatively small in diameter such that the hole punch 240*b* is formed into a different-diameter shape for pre-forming of the first inner step 46 on the middle region of the inner circumferential surface of the metal shell formed body 30*f*.

An extrusion sleeve (cylindrical tube) 250*b*, which has a larger inner diameter than the outer diameter of the hole punch 240*b*, is coaxially fitted around the hole punch 240*b* through a spacer (cylindrical tube) 260*b*. By the spacer (cylindrical tube) 260*b*, a front end part of the extrusion sleeve 250*b* is maintained at a predetermined space (cylindrical clearance) apart from the hole punch 240 throughout its circumference. As the thin annular crimp portion 38 is formed by extrusion in the space (cylindrical clearance), the space (cylindrical clearance) is maintained in front of the spacer (cylindrical tube) 260*b* at all times in the present invention. An inner circumferential surface of the extrusion sleeve 250*b* is circular in shape. An inner diameter of the extrusion sleeve 250*b* is set slightly smaller than the outer diameter of the large-diameter part 39*a* of the first-step formed product 30*a* and substantially equal to the outer diameter of the thin annular crimp portion 38 of the metal shell formed body 30*f* of FIG. 13. An outer circumferential surface of the extrusion sleeve 250*b* is circular in shape such that the extrusion sleeve 250*b* is fittable in the circular hole 207*b* of the die 200*b* by clearance fitting. The extrusion sleeve 250*b* is vertically movable in synchronism with or separately from the hole punch 240*b* so as to extrude the thin annular crimp portion 38 toward the rear between the front end region of the inner circumferential surface of the extrusion sleeve 250*b* and the outer circumferential surface of the hole punch 240*b*.

Figure 3:
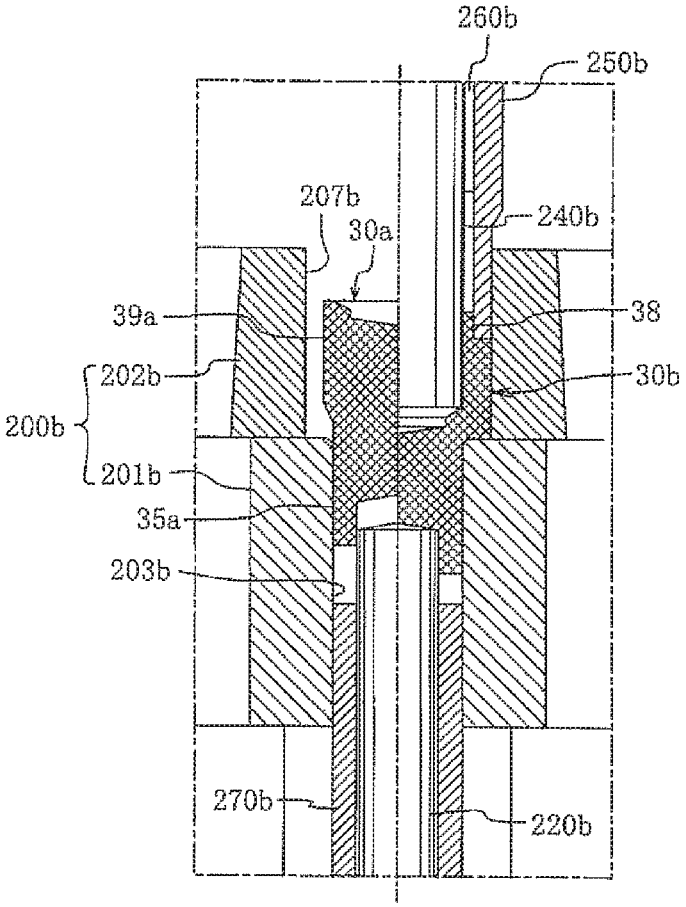
FIG. 3 schematically shows the second step for formation of the semi-finished formed body (B) of FIG. 1 by the use of a die, where the left side is a section view of the formed body before extrusion; and the right side is a section view of the formed body after extrusion.

In the second step, the small-diameter part 35*a* of the first-step formed product 30*a* is inserted and placed in the circular hole 203*b* of the die 200*b* as shown in the left side of the center line in FIG. 3. After the insertion and placement of the formed body, the cylindrical column-shaped supporting pin 220*b* and the sleeve 270*b* are inserted into the circular hole 203*b* from below; and the hole punch 240*b* and the extrusion sleeve 250*b* are inserted into the circular hole 203*b* from above. The first-step formed product 30*a* is compressed between these dies 220*b*, 270*b* and 240*b*, 250*b*. More specifically, the extrusion sleeve 250 is pushed down as appropriate so as to engage an upper end portion of the large-diameter part 39*a* of the first-step formed product 30*a*. Then, the hole punch 240*b* is pushed into a rear end face of the large-diameter part 39*a* of the first-step formed body 30*a* by a predetermined stroke. By such pushing, the bottomed hole is formed, with a predetermined depth and a diameter substantially equal to the inner diameter of the inner circumferential surface 48 (large-diameter hole region 48*a*) of the body part 39, in the rear end face of the large-diameter part 39*a* of the first-step formed body 30*a* as shown in the right side of the center line in FIG. 3. At this time, the first inner step 46 is pre-formed. At the completion of the above pushing operation, the thin annular crimp portion 38 is formed by extrusion between the front end region of the inner circumferential surface of the extrusion sleeve 250*b* and the outer circumferential surface of the hole punch 240*b* (see the right side of the center line in FIG. 3). Thus, a second-step formed product 30*b* having at its rear end the thin annular crimp portion 38 is obtained (see FIG. 1-B).

Third Step

Figure 4:
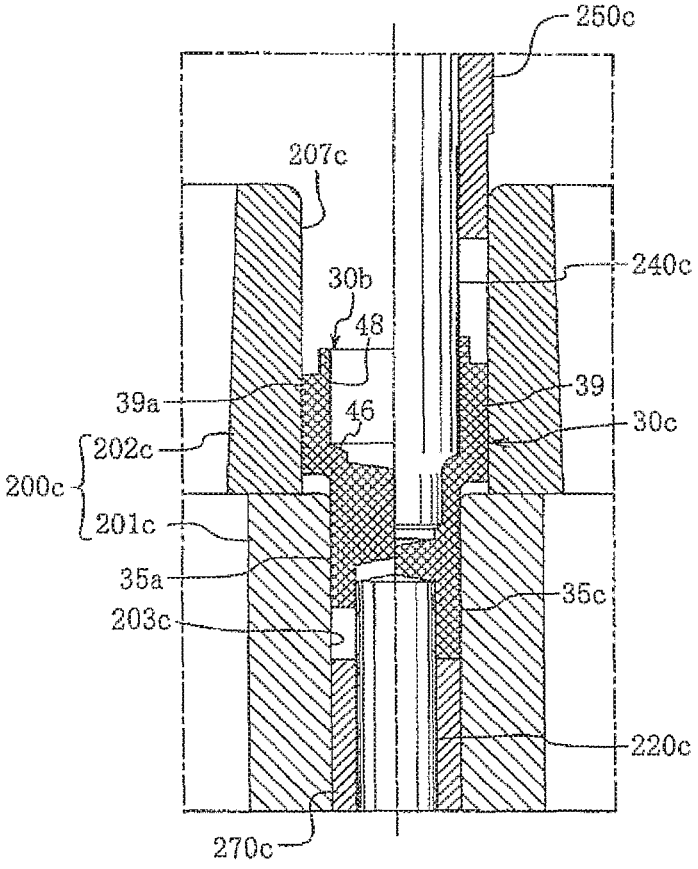
FIG. 4 schematically shows the third step for formation of the semi-finished formed body (C) of FIG. 1 by the use of a die, where the left side is a section view of the formed body before extrusion; and the right side is a section view of the formed body after extrusion.

As explained below with reference to FIG. 4, the third step is performed to elongate the cylindrical part (small-diameter part 35*a* and large-diameter part 39*a*) of the second-step formed product 30*b*. In the third step, dies such as lower die and hole punch are used as shown in FIG. 4. The die (lower die) 200*c* assembled from first and second lower die components 201*c* and 202*c*. The first lower die component 201*c* has a circular hole 203*c* shaped to restrain the outer circumferential surface of the small-diameter part 35*a* of the second-step formed product 30*b*, whereas the second lower die component 202*c* is located above the first lower die component 201*c* and has a circular hole 207*c* formed coaxial with the circular hole 203*c* and shaped to restrain the outer circumferential surface of the large-diameter part 39*a* of the second-step formed product 30*b*. As in the case of the second step, a cylindrical column-shaped supporting pin 220*c* and a cylindrical sleeve 270*c* are inserted into the circular hole 203*c* of the die 200*c* from below. The die 200*c* is thus similar in structure to that used in the second step although the height (axial length) of the second lower die component 202*c* is set larger than that in the second step.

A deep hole punch 240*c* is arranged at an upper side of the die (lower die) 200*c* coaxially (concentrically) with the circular holes 203*c* and 207*c*. This deep hole punch 240*c* is adapted to perform deep perforation to perforate the large-diameter hole region 48*a* of the large-diameter part 39*a* of the second-step formed product 30*b* toward the front relative to the first inner step 46 and thereby form the first middle-diameter hole region 41*a* as corresponding to the inner circumferential surface 41 of the cylindrical intermediate portion 35 of the metal shell formed body and, at the same time, elongate (extrude toward the front) the small-diameter part 35*a* and thereby form the cylindrical intermediate portion 35. As the body part 39 of the metal shell formed body 30*f* and the first middle-diameter hole region 41*a* of the cylindrical intermediate portion 35 are shaped by the hole punch 240*c*, the hole punch 240*c* has a front end part substantially equal in diameter to the inner diameter of the cylindrical intermediate portion 35 and a rear part set substantially equal in diameter to the inner diameter of the body part 39, with a press surface (annular stepped surface) being defined therebetween for formation of the first inner step 46. A small-diameter portion is provided on a front end of the hole punch 240*c*. As shown in the left side of the center line in FIG. 4, the second-step formed product 30*b* is inserted and placed in the circular holes 203*c* and 207*c*. The deep hole punch 240*c* is then pushed down into the bottom of the hollow rear end region of the second-step formed product 30*b* by a predetermined stroke, thereby compressing the second-step formed product 30*b* between an end face of the hole punch 240*c* and an end face of the cylindrical column-shaped supporting pin 220*c* while extruding the small-diameter part toward the front to form a cylindrical portion 35*c* to be processed into the cylindrical intermediate portion 35. At this time, the body part 39 is extruded and elongated toward the rear. Thus, a third-step formed product 30*c* is obtained (see FIG. 1-C). Herein, the pushing stroke of the deep hole punch 240*c* is set in such a manner as to leave a bottom wall K of predetermined thickness on a region of the inner circumferential surface 41 of the cylindrical portion 35*c* corresponding to the small-diameter hole region 43*a* of the metal shell formed body.

Fourth Step

Figure 5:
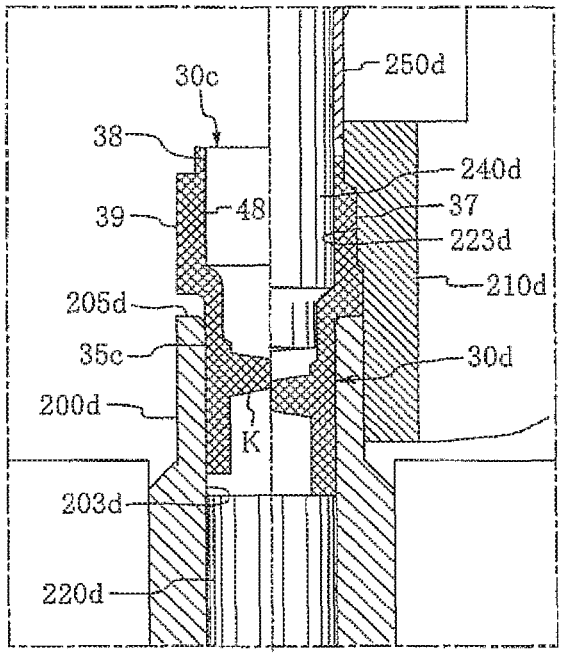
FIG. 5 schematically shows the fourth step for formation of the semi-finished formed body (D) of FIG. 1 by the use of a die, where the left side is a section view of the formed body before extrusion; and the right side is a section view of the formed body after extrusion.

As will be explained below with reference to FIG. 5, the fourth step is performed to form the polygonal portion 37 on the outer circumferential surface of the body part 39 of the third-step formed product 30*c*. In the fourth step, a die (lower die) with a cylindrical support member 200*d* and a cylindrical column member 210*d* is used as shown in FIG. 5. The cylindrical support member 200*d* has a circular hole 203*d* shaped to hold therein the cylindrical portion 35*c* of the third-step formed product 30*c* with a slight clearance left therebetween and a supporting rear end surface 205*d* shaped to, when the cylindrical portion 35 is inserted in the circular hole 203*d*, support thereon an annular front-facing surface of the third-step formed product 30 formed in rear of the cylindrical portion 35*c*. The cylindrical column member 210*d* is arranged on an inner circumference of the cylindrical support member 200*d* so as to support a front end (lower end) of the cylindrical portion 35*c* by an upper end (tip end) of the cylindrical column member 210*d*.

Also used is an upper die assembled from an inner circumferential surface supporting die component 240*d* and a polygonal portion forming die component 220*d*. The inner circumferential surface supporting die component 240*d* has a cylindrical column shape formed with a different-diameter front end so as to, when the inner circumferential surface supporting die component 240*d* is inserted into the third-step formed product 30*c* from its rear end side, allow a clearance left between the front end of the inner circumferential surface supporting die component 240*d* and the bottom wall K but substantially no clearance between the inner circumferential surface supporting die component 240*d* and the inner circumferential surface 48 of the third-step formed product 30*c*. The polygonal portion forming die component 220*d* is arranged coaxially with the inner circumferential surface supporting die component 240*d* and has an inner circumferential surface (polygonal portion forming surface) shaped to form the polygonal portion 37 on the outer circumferential surface of the body part 39 of the third-step formed product 30*c* by being pushed from above. The inner circumferential surface of the polygonal portion forming die component 220*d* includes a front region formed into a circular shape so as to surround the large-diameter part of the third-step formed product 30*c* with substantially no clearance left therebetween and a rear region formed over a predetermined range and, when viewed in section, having its inner circumference 223*d* in agreement with the outer profile of the polygonal portion 37 of the metal shell formed body 30*f*. The polygonal portion forming die component 220*d* is coaxially disposed around the inner circumferential surface supporting die 240 via a collar sleeve 250*d* so as not to cause interference of the polygonal portion forming die component 220*d* with the thin annular crimp portion 38 during this forming operation.

The third-step formed product 30*c* is inserted from its cylindrical portion 35 into the cylindrical support member (lower die) 200*d*. The inner circumferential surface supporting die component (upper die) 240*d* is pushed down by a predetermined stroke. In such a state, the polygonal portion forming die component 220*d* is pushed down by a predetermined stroke. By this, a given axial region of the outer circumferential surface of the body part 39 of the third-step formed product 30 is extruded and formed as the polygonal portion 39. Thus, a fourth-step formed product 30*d* is obtained (see FIG. 1-D).

Fifth Step

Figure 6:
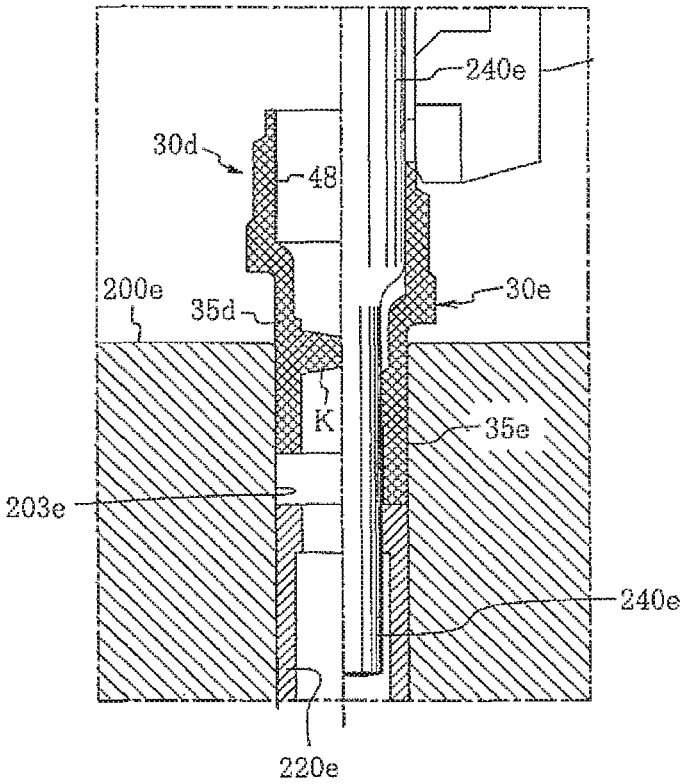
FIG. 6 schematically shows the fifth step for formation of the semi-finished formed body (E) of FIG. 1 by the use of a die, where the left side is a section view of the formed body before extrusion; and the right side is a section view of the formed body after extrusion.

As shown in FIG. 6, the fifth step is performed to punch out the remaining bottom wall K of the deep hole of the fourth-step formed product 30*d* by the use of a stamping punch. A die 200*e* is also used, having a circular hole 203*e* shaped to mate with the cylindrical portion 35*d* of the fourth-step formed product. Further, a cylindrical column member 200*e* is coaxially arranged in the circular hole of the die so as to support a front end of the cylindrical portion 35*d*. As shown in the left side of FIG. 6, the cylindrical portion 35*d* of the fourth-step formed product 30*d* is inserted and placed in the circular hole 203*e*. In such a state, the bottom wall K is punched out from above by the cylindrical stamping punch 240*e* as shown in the right side of FIG. 6. Thus, a fifth-step formed product 30*e* with an axial through hole is obtained (see FIG. 1-E). In this punching operation, the small-diameter hole region 43*a* is formed with the inner circumferential surface 43 by shearing of the bottom wall K. The inner circumferential region of the formed body located in front of the small-diameter hole region 43*a* is defined as the second middle-diameter hole region 41*b* smaller in diameter than the small-diameter hole region 43*a*. The inner circumferential surface 43 of the small-diameter hole region 43 is consequently shaped as an annular inward protrusion, thereby forming not only the second inner step 44 between the first middle-diameter hole region 41*a* and the small-diameter hole region 43*a* but also an annular front-facing step 45 between the small-diameter hole region 43*a* and the second middle-diameter hole region 41*b*. By the above punching operation, there is obtained the fifth-step formed product 30*e* (as corresponding to the semi-finished formed body) having formed thereon the cylindrical part 35*e* to be processed into the cylindrical intermediate portion 35. The metal shell formed body 30*f* is obtained by forming the annular front end portion 32 on the fifth-step formed product 30*e* in the subsequent step (sixth step).

Sixth Step

Figure 7:
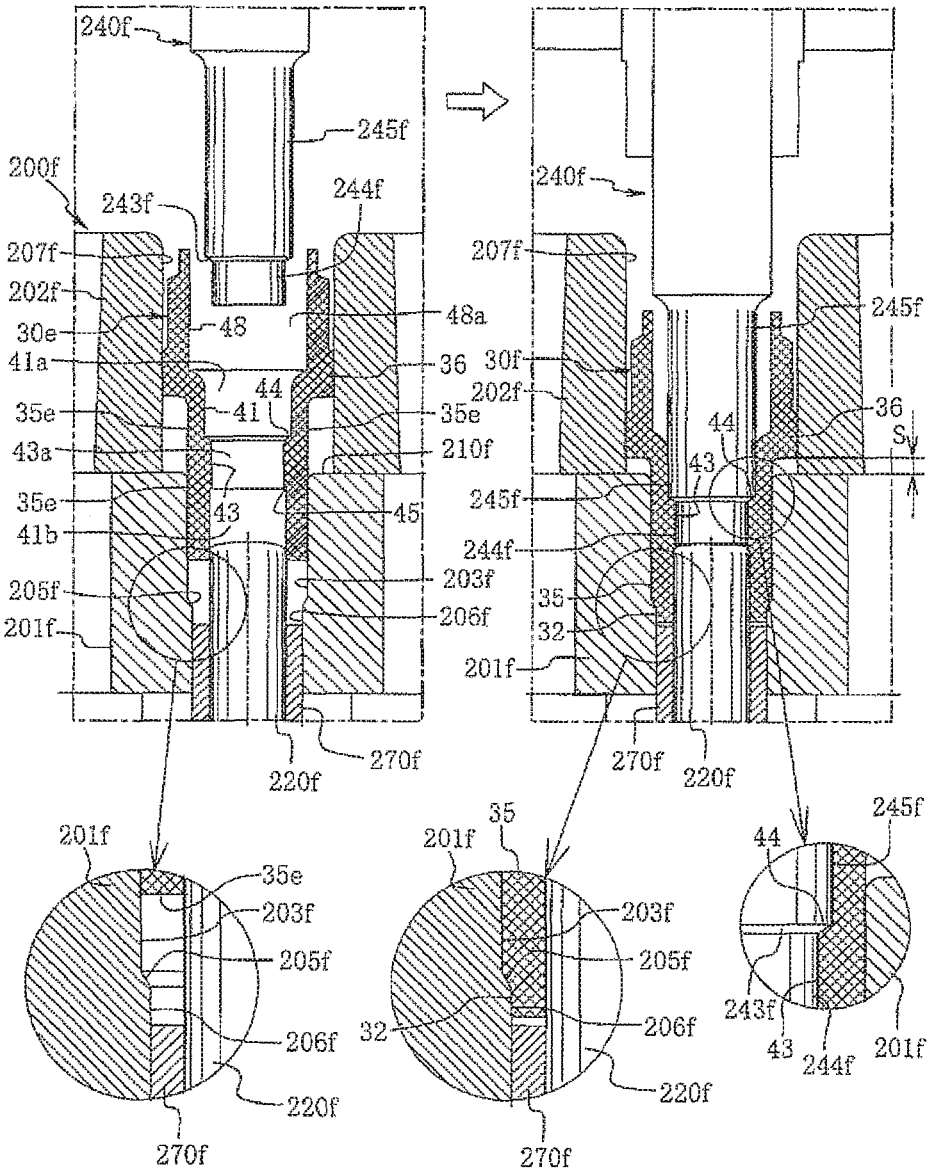
FIG. 7 schematically shows the sixth step (final forming step) for formation of the metal shell formed body (F) of FIG. 1 with the annular front end portion by the use of a die, where the left side (left illustration) is a section view of the formed body before extrusion; and the right side (right illustration) is a section view of the formed body after extrusion.

The sixth step (final cold forging step) is performed with the use of the die as shown in FIG. 7. The lower die 200*f* is assembled from two vertically aligned die components 201*f* and 202*f*. As mentioned above, the first lower die component 201*f* has a circular hole formed with the inner circumferential cylindrical surface 203*f* and the reduced-diameter inner cylindrical surface 206*f* such that the cylindrical part 35*e* of the fifth-step formed product 30*e* is fittable in the circular hole by clearance fitting. The inner circumferential cylindrical surface 203*f* is shaped to mate with the cylindrical part 35*e* of the fifth-step formed product 30*e*. The reduced-diameter inner cylindrical surface 206*f* is located below and coaxially with the inner circumferential cylindrical surface 203*f* and is formed with a reduced inner diameter equal to the outer diameter of the annular front end portion 32 so as to shape the outer circumferential surface of the annular front end portion 32. The tapered inner circumferential surface 205*f* is formed between the inner circumferential cylindrical surface 203*f* and the reduced-diameter inner cylindrical surface 206*f* and tapered down toward the front. Herein, the annular front end portion forming surface is constituted by the inner circumferential cylindrical surface 203*f*, the tapered inner circumferential surface 205*f* and the reduced-diameter inner cylindrical surface 206*f*. A cylindrical column member 220*f* is coaxially inserted from below in the circular hole of the first lower die component 201*f*. This die is shaped to be fitted in the second middle-diameter hole region 41*b*, which is located in front of the small-diameter hole region 43*a* on the inner circumferential surface 41 of the cylindrical part 35*e*, with no clearance left therebetween, and thereby restrain the inner circumferential surface of the second middle-diameter hole region 43*a* by its outer circumferential surface and, at the same time, allow contact between its upper end and the front-facing step 45 of the small-diameter hole region 43*a*. Further, a sleeve 270*f* is arranged around the cylindrical column member 220*f* so as to kick out the formed product after the extrusion of the annular front end portion 32 in the sixth step. The second lower die component 202*f* is located on an upper surface 210*f* of the first lower die component 201*f* and has a circular hole 207 formed coaxial with the circular hole of the inner circumferential cylindrical surface 203*f* so as to receive therein the flange 36 of the fifth-step formed product 30*e* by clearance fitting.

The punch (annular front end portion forming punch) 240*f* is arranged at an upper side of the lower die 200*f* coaxially with the circular hole 207*f*. The annular front-facing surface 243*f* of the punch 240*f* is shaped to, when the punch 240*f* is inserted in the fifth-step formed product (semi-finished formed body) 30*e* from its rear end side, push the second inner step 44 of the small-diameter hole region 43*a*. The punch 240*f* has a front end part (lower end part) 244*f* located in front of the annular front-facing surface 243*f* and formed with a small outer diameter so as to be fitted in the small-diameter hole region 43*a* and a circular shaft part 245*f* located in rear of the front end part and formed with an outer diameter so as to be fitted in the first middle-diameter hole region 41*a* of the cylindrical part 35*e* with substantially no clearance left therebetween.

Figure 16:
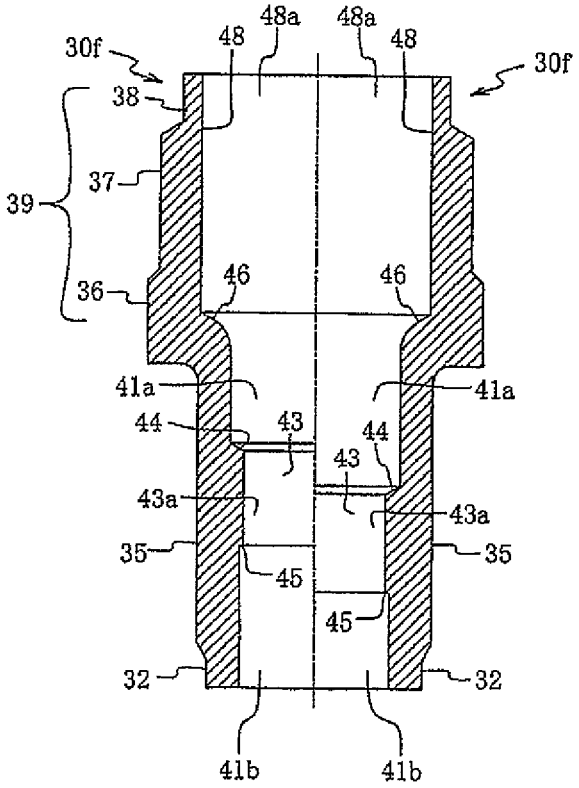
FIG. 16 schematically shows a comparison of metal shell formed bodies having the same thread diameter and thread length (length of cylindrical intermediate portion) but different axial positions of second inner steps.

In the sixth step, the semi-finished formed body 30*e* is inserted and placed in the die so that the cylindrical part 35*e* of the semi-finished formed body 30*e* is fitted in and mates with the inner circumferential cylindrical surface 203*f* of the first lower die component 201*f* as shown in the left side of FIG. 7. The punch (annular front end portion forming punch) 240*f* is pushed into the semi-finished formed body 30*e* so as to push the annular front-facing surface 243*f* onto the second inner step 44 of the small-diameter hole region 43*a* (see the enlarged area in the right side of FIG. 7). Then, the semi-finished formed body 30*e* is forced toward the front such that the outer circumferential surface of the front end portion of the cylindrical part 35*e* is pressed against the annular front end portion forming surface such as tapered inner circumferential surface 205*f* of the die (first lower die component 2010 as shown in the right side of FIG. 7 (see, in particular, the middle enlarged area of FIG. 7). By the above pushing operation, the annular front end portion 32 is extruded toward the front (lower side of FIG. 7). The semi-finished formed body 30*e* is thus processed into the metal shell formed body 30*f*. Namely, the metal shell formed body 30*f* in which the annular front end portion 32 is formed in front of the cylindrical middle portion 35 (see the enlarged area in FIG. 1-F) is obtained as desired as shown in FIG. 16 through the cold forging process.

As the axial length of the annular front end portion 32 varies depending on the pushing amount (stroke) of the punch (annular front end portion forming punch) 240*f*, it is feasible to set the pushing amount of the punch 240*f* according to the desired axial length of the annular front end portion 32. In the pushing operation, the stroke of the punch 240*f* may be set by locking a front end of the punch 240*f* on a tip end of the cylindrical column member 220*f* in the circular hole of the lower die component 201*f*. In other words, the punch 240*f* and the lower die 200*f* may be so structured as to, when the annular front end portion 32 is formed by pushing the punch 240*f* and pressing the front end portion of the cylindrical part 35*e* toward the front, bring the lower end of the punch 240*f* into contact with the tip end of the cylindrical column member 220*f* inside the lower die 200*f*.

As described above, the annular front end portion 32 is formed in front of the cylindrical intermediate portion 35 in the final step of the cold forging process for manufacturing of the metal shell formed body in the present embodiment. This enables manufacturing of the metal shell formed bodies by forming the annular front end portions 32 with the use of one kind of die (first lower die component 201*f*) in the step for completion of the metal shell formed bodies, as long as the annular front end portions 32 are the same in shape and dimension, even in the case where the metal shells differ in the axial position of the second inner step 44 or slightly differ in the length of the thread 34 although the threads 34 formed on the outer circumferential surfaces of the cylindrical intermediate portions 35 are the same in diameter. It is therefore possible to significantly reduce the number of dies, as compared to that in the conventional manufacturing method, for cost reduction of the metal shell formed body 30*f*. As also obvious from FIG. 7, the above process can be applied even in the case where the metal shells slightly differ in the length of the thread. The reason for this is that there is a clearance S left between the front-facing surface of the flange 36 and the upper surface of the first lower die component 201*f* (see the right side of FIG. 7) during the formation of the metal shell formed body 30*f* with the annular front end portion 32.

The thus-obtained metal shell formed body 30*f*, or the metal shell cut body obtained by cutting of the metal shell formed body 30*f*, is completed as a metal shell 30 by welding the ground electrode to the front end of the formed body and forming (by e.g. rolling) the thread on at least part of the outer circumferential surface of the cylindrical intermediate portion of the formed body. There is obtained a spark plug 1 by placing an insulator with a center electrode etc. into the metal shell 30. The use of such a metal shell 30 allows a reduction in the cost of the spark plug.

In the above embodiment, the punch (annular front end portion forming punch) 240*f* is pushed into the semi-finished formed body 30*e* from its rear end side so as to push the annular front-facing surface 243 of the punch 240*f* onto the second inner step 44 of the semi-finished formed body 30*e*, force the semi-finished formed body 30*e* toward the front and thereby press the front end portion of the cylindrical part 35*e* against the tapered inner circumferential surface 205*f* of the die component 201*f*. The annular front end portion 32 is formed by such pushing operation in the above embodiment. In the present invention, however, the part of the semi-finished formed body 30*e* pushed by the punch is not limited to the second inner step 44 as mentioned above. For example, it is feasible to form the annular front end portion 32 in the sixth step (final forming step) by the use of a punch having an annular front-facing surface shaped to push the first inner step 46 of the semi-finished formed body 30*e*. This alternative embodiment will be explained later in detail. Further, the annular front end portion 32 is formed in the annular front end portion forming step subsequent to the formation of the semi-finished formed body 30*e* in which the second inner step 44 is provided between the first middle-diameter hole region 41*a* and the small-diameter hole region 43*a* in the above embodiment. In the present invention, however, the step for forming the second inner step 44 between the first middle-diameter hole region 41*a* and the small-diameter hole region 43*a* and the step for forming the annular front end portion 32 may be performed after the formation of the semi-finished formed body.

Figure 8:
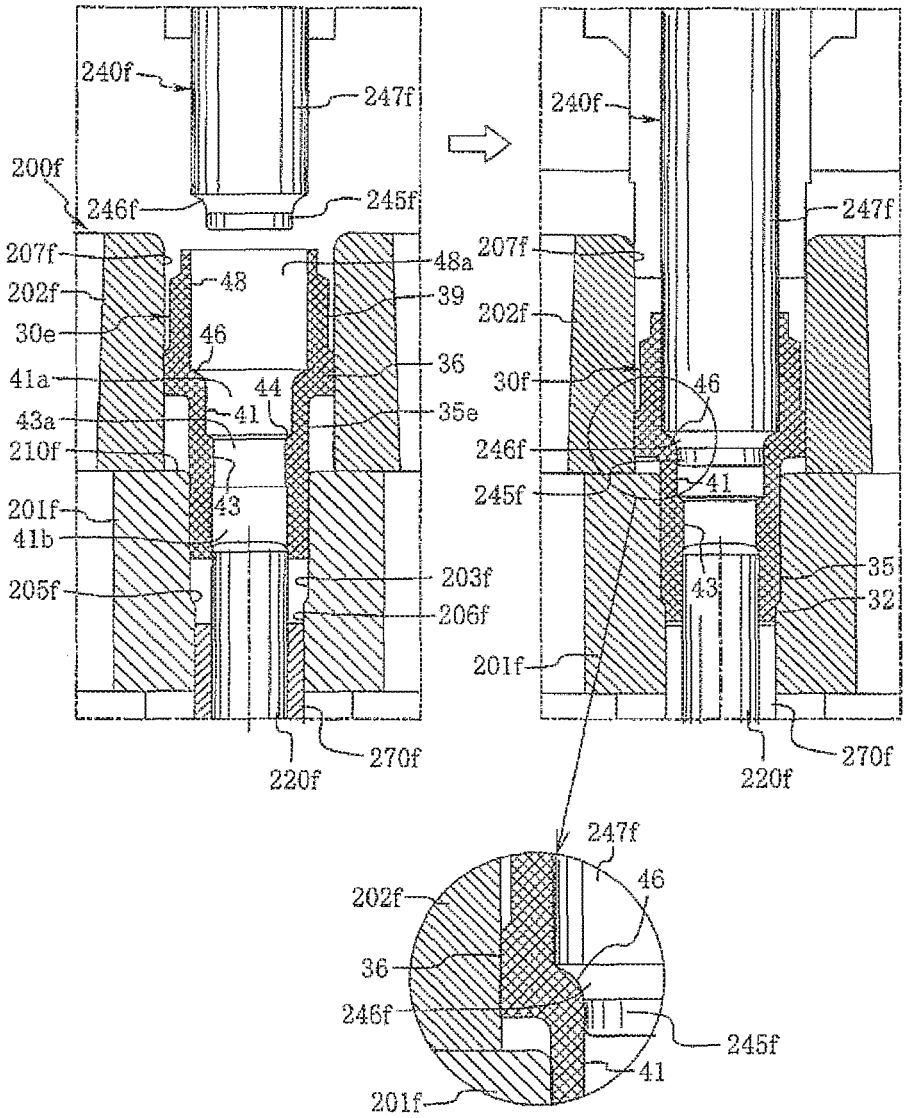
FIG. 8 shows one example of the sixth step (final forming step) for formation of the annular front end portion by pressing a first inner step of the semi-finished formed body (E) with an annular front-facing surface of a punch while holding the formed body in the die, where the left side (left illustration) is a section view of the formed body before extrusion; and the right side (right illustration) is a section view of the formed body after extrusion.

Hereinafter, the embodiment in which the first inner step 46 of the semi-finished formed body 30*e* is pushed in the sixth step will be explained with reference to FIG. 8. This embodiment is different from the above embodiment, only in the configuration of the punch (annular front end portion forming punch) 240*f* pushed into the semi-finished formed body 30*e* in the step of FIG. 7. Thus, the same parts and portions (corresponding parts and portions) are designated by the same reference numerals as those in FIG. 7; and only the differences in configuration will be explained below. In this embodiment, the punch (annular front end portion forming punch) 240*f* has a circular shaft part 247*f* shaped so as to, when the punch 240*f* is pushed into the semi-finished formed body 30*e* from the rear, be inserted by clearance fitting in the large-diameter hole region 48*a* of the body part 39 of the semi-finished formed body 30*e* as shown in the left side of FIG. 8. The punch 240*f* also has a circular shaft part 245*f* formed coaxially in front of the circular shaft part 247*f* and made smaller in diameter than the circular shaft part 247*f* so as to be fitted in the first middle-diameter hole region 41*a* of the cylindrical part 35*e* by clearance fitting. There is an annular front-facing surface 246*f* defined on a boundary between these circular shaft parts 245*f* and 247*f* so as to push the first inner step 46 of the semi-finished formed body 30*e*. As shown in FIG. 8, the annular front-facing surface 246*f* is concave curved in shape corresponding to the convex curved cross-sectional profile of the first inner step 46.

Accordingly, the punch (annular front end portion forming punch) 240*f* is pushed into the semi-finished formed body 30*e* from the rear as shown in the right side of FIG. 8 in this embodiment. Then, the annular front-facing surface 246*f* of the punch 240 is pushed onto the front inner step 46 of the semi-finished formed body 30*e* so as to force the semi-finished formed body 30*e* toward the front as shown in the enlarged area of the FIG. 8. In such pushing, the annular front end portion 32 is formed by pressing the front end region of the outer circumferential surface of the cylindrical part 35*e* against the tapered inner circumferential surface 205*f* and the reduced-diameter inner cylindrical surface 206*f* of the die component 201*f* as in the case of FIG. 7. As the first inner step 46 is larger in inner diameter than the second inner step 44, it is possible in this embodiment ensure not only a pushing position radially closer to the annular front end portion 32 when axially viewed (from the rear) but also a large pushing area for stable pushing.

Figure 9:
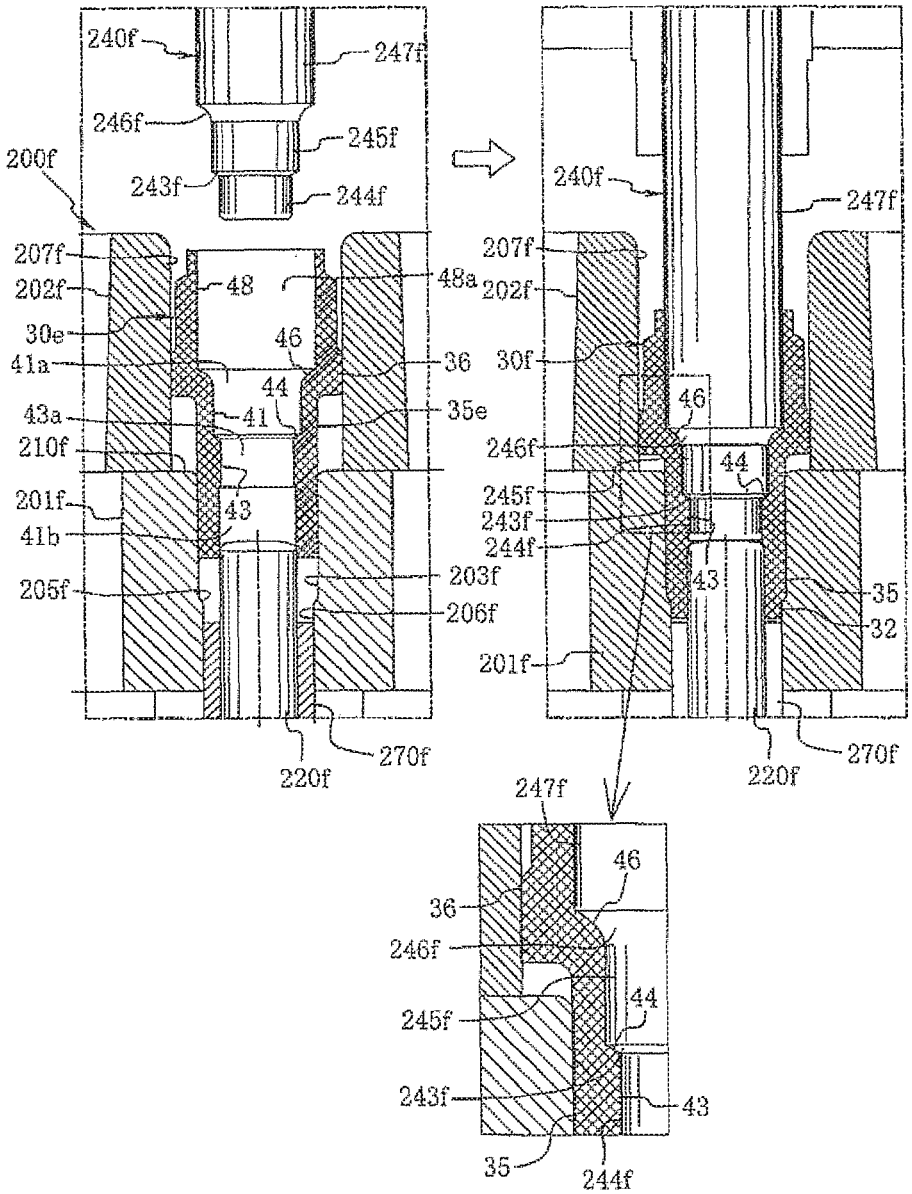
FIG. 9 shows another example of the sixth step (final forming step) for formation of the annular front end portion by pushing first and second inner steps of the semi-finished formed body (E) with a punch while holding the formed body in the die, where the left side (left illustration) is a section view of the formed body before extrusion; and the right side (right illustration) is a section view of the formed body after extrusion.

In another alternative embodiment of FIG. 9, the punch (annular front end portion forming punch) 240*f* may be formed corresponding to the combination of the punches of FIGS. 7 and 8 so as to push both of the second inner step 44 and the first inner step 46 of the semi-finished formed body (E) by two front and rear annular front-facing surfaces 243*f* and 246*f* (see the enlarged area of FIG. 9). In this alternative embodiment, the punch 240*f* has a small-diameter front end part (lower end part) 244*f* shaped to be fitted in the small-diameter hole region 43*a*, a circular shaft part 245*f* shaped to be fitted in the first middle-diameter hole region 41*a* of the cylindrical intermediate portion 35, with substantially no clearance left therebetween, and a circular shaft part 247*f* shaped to be fitted by clearance fitting in the large-diameter hole region 48*a* of the body part 39 (see the left side of FIG. 9). These parts 244*f*, 245*f* and 247 are arranged coaxially in the order from the front such that the punch 240*f* becomes larger in diameter toward the rear. The annular front-facing surface 243*f* is formed on a boundary between the front end part (lower end part) 244*f* and the circular shaft part 245*f* so as to push the second inner step 44. The annular front-facing surface 246*f* is formed into a concave curved shape on a boundary between the circular shaft part 245*f* and the circular shaft part 247*f* so as to push the first inner step 46. By the use of such a punch 240*f*, it is possible to ensure a larger pushing area for more stable pushing.

In the case of using the punch of FIG. 9, the forming operation is performed as follows. The punch (annular front end portion forming punch) 240*f* is first pushed into the semi-finished formed body 30*e* so as to simultaneously allow pushing of the annular front-facing surface 243*f* onto the second inner step 44 of the small-diameter hole region 43*a* and pushing of the annular front-facing surface 246*f* onto the first inner step 46 (see the enlarged area of FIG. 9). Then, the semi-finished formed body 30*e* is forced toward the front such that the outer circumferential surface of the front end portion of the cylindrical part 35*e* is pressed against the annular front end portion forming surface such as tapered inner circumferential surface 205*f* of the die (first lower die component 2010. By the above pushing operation, the annular front end portion 32 is extruded toward the front. The semi-finished formed body 30*e* is thus processed into the metal shell formed body 30*f*. Namely, the metal shell formed body 30*f* in which the annular front end portion 32 is formed in front of the cylindrical middle portion 35 (see the enlarged area in FIG. 1-F) is obtained as desired as shown in FIG. 16 through the cold forging process. In the punch (annular front end portion forming punch) 240*f* of FIG. 9, the axial dimensions of the two front and rear annular front-facing surfaces 243*f* and 246*f* are set as appropriate according to the axial dimension of the second inner step 44 of the small-diameter hole region 43*a* and the axial dimension of the first inner step 46 of the metal shell finished body, respectively.

Figure 10:
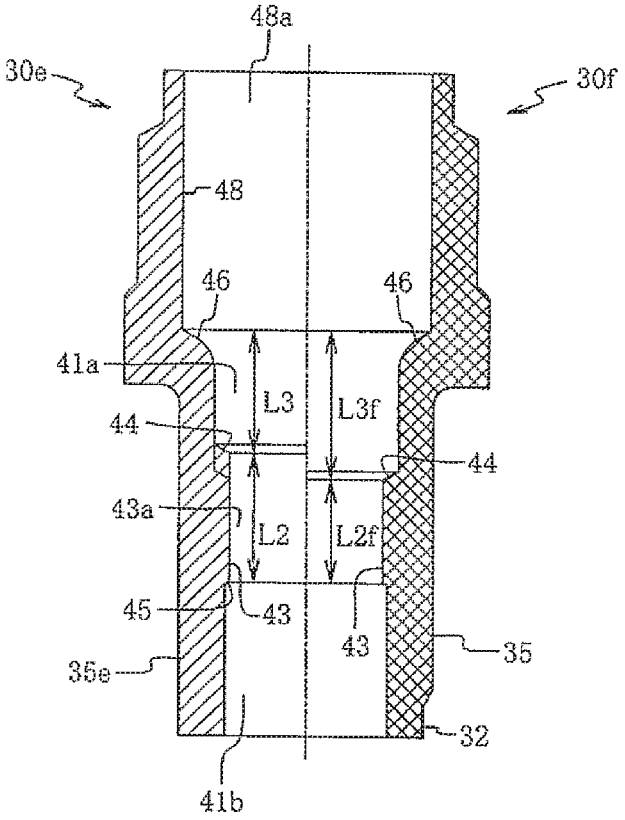
FIG. 10 shows a state where the axial dimension L2 of a small-diameter hole region of the semi-finished formed body (E) is larger than a design dimension L2*f* of the metal shell formed body (F); and the axial dimension L3 from the second inner step to the first inner step in the small-diameter hole region of the semi-finished formed body (E) is smaller than a design dimension L3*f* of the metal shell formed body (F).
Figure 11:
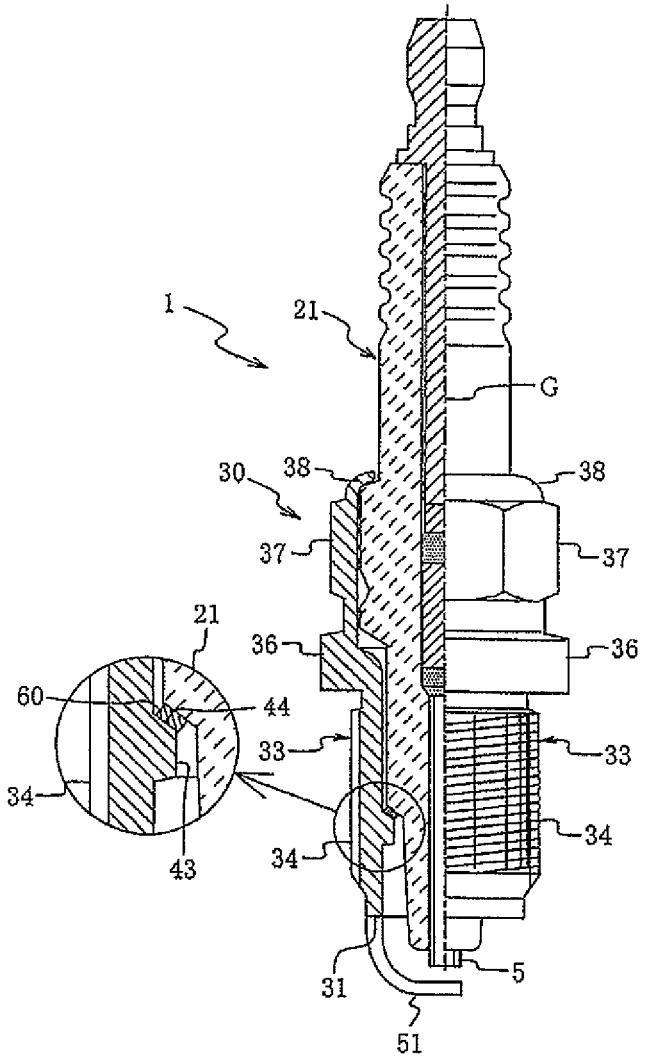
FIG. 11 shows a cross section of a conventional type of spark plug.

Alternatively, the second inner step 44 at the rear end of the small-diameter hole region 43 of the semi-finished formed body 30*e* may be a tapered portion reduced in diameter toward the front and temporarily provided during the forming operation (in an unfinished state), i.e., a temporary tapered portion (temporary second inner step; hereinafter referred to as "temporary tapered portion") as shown in the left section view of FIG. 10. In this case, the annular front-facing surface 243*f* of the punch 240*f* of FIG. 9 serves as a small-diameter hole region forming surface to push the temporary tapered portion 44 and shape the small-diameter hole region 43*a* with the temporary tapered portion 44 to a design dimension during the formation of the annular front end portion 32. For the formation of the annular front end portion 32, the punch 240*f* is pushed into the semi-finished formed body 30*e* from the rear so as to push the temporary tapered portion 44, i.e., the unfinished second inner step by the annular front-facing surface 243*f*, i.e., the small-diameter hole region forming surface and force the semi-finished formed body 30*e* toward the front. By such pushing, the annular front end portion 32 is cold forged by pressing the front end portion of the semi-finished formed body 30*e* against the reduced-diameter inner cylindrical surface 206*f* and the tapered inner circumferential surface 205*f* of the die. Simultaneously, the second inner step 44 is cold forged by pressing the small-diameter hole region forming surface against the temporary tapered portion.

In the case of pushing both of the second inner step 44 and the first inner step 46 of the semi-finished formed body 30*e*, it is preferable to perform the forming operation as follows. An axial dimension L2 of the small-diameter hole region 43*a* of the semi-finished formed body 30*e* as shown in the left section view of FIG. 10 is set larger than a design dimension L2*f* of the small-diameter hole region 43 of the metal shell formed body 30*f* as shown in the right section view of FIG. 10; and an axial dimension L3 from the second inner step 44 of the small-diameter hole region 43*a* to the first inner step 45 of the semi-finished formed body 30*e* as shown in the left section view of FIG. 10 is set smaller than a design dimension L3*f* between the inner steps 44 and 46 of the metal shell formed body 30*f* as shown in the right section view of FIG. 10. Then, the annular front end portion 32 is extruded toward the front such that both of the dimensions L2 and L3 are simultaneously adjusted to the respective design dimensions L2*f* and L3*f*. In other words, the axial dimension (design dimension) L3*f* from the second inner step 44 to the first inner step 46 is attained during the extrusion forming of the annular front end portion 32 in the cold forging process. It is possible by such forming operation to improve the accuracy of the axial dimension. Herein, the outer circumferential surface of the small-diameter front end part (lower end part) of the punch 240*f* fitted in the small-diameter hole region 43*a* as shown in FIG. 9 serves to shape the inner circumferential surface of the small-diameter hole region 43*a*. Further, the cylindrical column member 220*f* is inserted in the second middle-diameter hole region 41*b* from below so as to restrain the front-facing step 45 of the small-diameter hole region 43*a*.

In the present invention, the shape of the metal shell formed body is not limited to those of the above embodiments. The axial lengths of the cylindrical intermediate portion, the annular front end portion and the small-diameter hole region and the axial positions of the first and second inner steps can be set as appropriate. Further, it is possible in the present invention to manufacture the metal shell formed bodies by sharing the annular front end portion forming die in the cold forging step, even though the cylindrical intermediate portions slightly differ in length from one another, as long as the cylindrical intermediate portions are the same in outer diameter and the annular front end portions are the same in outer diameter. In all of the process steps (FIGS. 2-9) of the present invention, the respective formed bodies (A to F) of FIG. 1 are formed by cold forging. The punching of the fifth step (FIG. 6) is also included in the cold forging.

DESCRIPTION OF REFERENCE NUMERALS

1: Spark plug
21: Insulator of spark plug
30: Metal shell of spark plug
30*f*: Metal shell formed body
30*e*: Semi-finished formed body
32: Annular front end portion

34: Thread (screw thread)
35: Cylindrical intermediate portion
39: Body part
41: Inner circumferential surface of cylindrical intermediate portion
41*a*: First middle-diameter hole region
41*b*: Second middle-diameter hole region
43: Inner circumferential surface of small-diameter hole region
43*a*: Small-diameter hole region
44: Second inner step
46: First inner step
48*a*: Large-diameter hole region
200*f*: Die in which semi-finished formed body is inserted
201*f*: Die having annular front end portion forming portion in which semi-finished body is inserted
203*f*: Inner circumferential cylindrical surface of die in which semi-finished formed body is inserted
205*f*: Tapered inner circumferential surface of die in which semi-finished body is inserted
206*f*: Reduced-diameter inner cylindrical surface of die in which semi-finished body is inserted
240*f*: Punch (annular front end portion forming punch)
243*f*, 246*f*: Annular front-facing surface

The invention claimed is:

1. A method of manufacturing a metal shell formed body for a spark plug, the metal shell formed body comprising: a body part having formed therein an axial hole for insertion of an insulator and having formed thereon a radially outwardly protruding flanged portion; a cylindrical intermediate portion located in front of the body part; and an annular front end portion located in front of the cylindrical intermediate portion and made smaller in outer diameter than the cylindrical intermediate portion, the manufacturing method comprising the steps of:

a semi-finished formed body producing step for cold forging a metal material, to produce a semi-finished formed body with the flanged portion and the cylindrical intermediate portion, the flanged portion having a front facing surface, the semi-finished formed body having an axial hole faulted therein along a center axis thereof such that the axial hole includes, in order of mention from the rear to the front, a large-diameter hole region, a first middle-diameter hole region smaller in diameter than the large-diameter hole region, a small-diameter hole region smaller in diameter than the first middle-diameter hole region and a second middle-diameter hole region larger in diameter than the small-diameter hole region; and an annular front end portion forming step for, after the semi-finished formed body producing step, forming the annular front end portion by pushing a punch into the semi-finished formed body and thereby pressing a front end portion of the semi-finished formed body against a die while maintaining said front-facing surface of the flanged portion spaced from contact with the die.

2. The manufacturing method of the metal shell formed body for the spark plug according to claim 1, wherein the semi-finished formed body producing step includes forming a first inner step between the large-diameter hole region and the first middle-diameter hole region and forming a second inner step between the first middle-diameter hole region and the small-diameter hole region; and wherein the die is fittable around the semi-finished formed body by clearance fitting and having an inner circumferential cylindrical surface shaped to mate with the cylindrical intermediate portion, a reduced-diameter inner cylindrical surface smaller in inner diameter than the inner circumferential cylindrical surface and a tapered inner circumferential surface between the inner circumferential cylindrical surface and the reduced-diameter inner cylindrical surface;

wherein the punch has an annular front-facing surface shaped to push at least one of the first and second inner steps;

wherein the annular front end portion forming step includes:

inserting and placing the semi-finished formed body from a front end side thereof into the die; and pushing the punch into the semi-finished formed body from a rear end side thereof so as to, by pushing of the annular front-facing surface onto at least one of the first and second inner steps, force the semi-finished formed body toward the front, press a front end portion of the semi-finished formed body against the reduced-diameter inner cylindrical surface and the tapered inner circumferential surface of the die and thereby form the annular front end portion by cold forging.

3. The manufacturing method of the metal shell formed body for the spark plug according to claim 2, wherein the punch is shaped to push both of the first and second inner steps and force the semi-finished formed body toward the front.

4. The manufacturing method of the metal shell formed body for the spark plug according to claim 3, wherein an axial dimension of the small-diameter hole region of the semi-finished formed body is larger than a design dimension of a small-diameter hole region of the metal shell formed body; and wherein an axial dimension from the first inner step to the second inner step of the semi-finished formed body is smaller than a design dimension between first and second inner steps of the metal shell formed body.

5. The manufacturing method of the metal shell formed body for the spark plug according to claim 1, wherein the semi-finished formed body producing step includes forming a first inner step between the large-diameter hole region and the first middle-diameter hold region; and wherein the manufacturing methods further comprises, after the semi-finished formed body producing step and before or in parallel with the annular front end portion forming step, a step for forming a second inner step between the first middle-diameter hole region and the small-diameter hole region.

6. The manufacturing method of the metal shell formed body for the spark plug according to claim 5, wherein the semi-finished formed body producing step includes forming a temporary tapered portion between the first middle-diameter hole region and the small-diameter hole region; and wherein the die is fittable around the semi-finished formed body by clearance fitting and having an inner circumferential cylindrical surface shaped to mate with the cylindrical intermediate portion, a reduced-diameter inner cylindrical surface smaller in inner diameter than the inner circumferential cylindrical surface and a tapered inner circumferential surface between the inner circumferential cylindrical surface and the reduced-diameter inner cylindrical surface;

wherein the punch has an annular front-facing surface shaped to push the first inner step and a small-diameter hold region forming surface shaped to push the temporary tapered portion; wherein the annular front end portion forming step includes:

inserting and placing the semi-finished formed body from a front end side thereof into the die; and pushing the punch into the semi-finished formed body from a rear end side thereof so as to, by at least one of pushing of the annular front-facing surface onto the first inner step and pushing of the small-diameter hole region forming surface onto the temporary tapered portion, force the semi-finished formed body toward the front, press a front end portion of the semi-finished formed body against the reduced-diameter inner cylindrical surface and the tapered inner circumferential surface of the die and thereby form the annular front end portion by cold forging and, at the same time, press the small-diameter hole region forming surface of the punch against the temporary tapered portion of the semi-finished formed body and thereby form the second inner step by cold forging.

7. The manufacturing method of the metal shell formed body for the spark plug according to claim 5, wherein an axial dimension of the small-diameter hole region of the semi-finished formed body is larger than a design dimension of a small-diameter hole region of the metal shell formed body; and wherein an axial dimension from the first inner step to the second inner step of the semi-finished formed body is smaller than a design dimension between first and second inner steps of the metal shell formed body.

8. A manufacturing method of a metal shell for a spark plug, further comprising:

manufacturing the metal shell formed body by the manufacturing method according to claim 1; and forming a thread on at least a part of the cylindrical intermediate portion of the metal shell formed body.

9. A manufacturing method of a spark plug, comprising:

manufacturing a metal shell by the manufacturing method according to claim 8; and placing an insulator in the metal shell formed body.

* * * * *